US008233823B2

(12) United States Patent
Adachi et al.

(10) Patent No.: US 8,233,823 B2
(45) Date of Patent: Jul. 31, 2012

(54) BELT DEVICE AND IMAGE FORMING APPARATUS

(75) Inventors: Tomoya Adachi, Hyogo (JP); Takafumi Miyazaki, Osaka (JP); Mitsutoshi Kichise, Osaka (JP); Takeshi Yamashita, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 499 days.

(21) Appl. No.: 12/171,613

(22) Filed: Jul. 11, 2008

(65) Prior Publication Data

US 2009/0016772 A1 Jan. 15, 2009

(30) Foreign Application Priority Data

Jul. 13, 2007 (JP) ..... 2007-184988
Oct. 11, 2007 (JP) ..... 2007-265863

(51) Int. Cl.
*G03G 15/00* (2006.01)

(52) U.S. Cl. ..... 399/165; 198/840

(58) Field of Classification Search ..... 399/162, 399/165, 302, 303, 308, 329, 312, 313; 198/806, 198/807, 810.3, 840
See application file for complete search history.

(56) References Cited

U.S. PATENT DOCUMENTS

| | | | | |
|---|---|---|---|---|
| 4,196,803 | A * | 4/1980 | Lovett | 198/806 |
| 6,053,832 | A * | 4/2000 | Saito | 474/122 |
| 6,970,674 | B2 * | 11/2005 | Sato et al. | 399/302 |
| 7,735,634 | B2 * | 6/2010 | Miyazaki et al. | 198/806 |
| 7,815,042 | B2 * | 10/2010 | Oishi | 198/837 |
| 2006/0210326 | A1 | 9/2006 | Takehara et al. | |
| 2006/0210327 | A1 | 9/2006 | Iwakura et al. | |
| 2007/0160396 | A1 | 7/2007 | Adachi et al. | |
| 2007/0231023 | A1 | 10/2007 | Miyazaki | |
| 2008/0138133 | A1 | 6/2008 | Hatayama et al. | |
| 2008/0152378 | A1 | 6/2008 | Yamashita et al. | |

FOREIGN PATENT DOCUMENTS

| | | | |
|---|---|---|---|
| CN | 1445622 | A | 10/2003 |
| DE | 3138755 | A1 * | 5/1982 |
| JP | 05001751 | A * | 1/1993 |
| JP | 5-134486 | | 5/1993 |
| JP | 9-15990 | | 1/1997 |
| JP | 09169445 | A * | 6/1997 |
| JP | 10-282751 | | 10/1998 |
| JP | 10310212 | A * | 11/1998 |
| JP | 11002980 | A * | 1/1999 |
| JP | 11-161055 | | 6/1999 |
| JP | 2001-183951 | | 7/2001 |
| JP | 2001-201904 | | 7/2001 |
| JP | 3223771 | | 8/2001 |

(Continued)

OTHER PUBLICATIONS

U.S. Appl. No. 12/010,797, filed Jan. 30, 2008.

(Continued)

*Primary Examiner* — Robert Beatty
(74) *Attorney, Agent, or Firm* — Oblon, Spivak, McClelland, Maier & Neustadt, L.L.P.

(57) ABSTRACT

A belt is supported by a plurality of rollers and is driven to move in a predetermined direction. A flange member is configured to make contact with a portion of an edge surface of the belt in its width direction. A pressing member presses on a surface of the belt in its thickness direction at a position near a contact portion of the belt with the flange member.

32 Claims, 17 Drawing Sheets

FOREIGN PATENT DOCUMENTS

| | | |
|---|---|---|
| JP | 2001-341883 | 12/2001 |
| JP | 2002-132057 | 5/2002 |
| JP | 3310338 | 5/2002 |
| JP | 2002-202703 | 7/2002 |
| JP | 3523503 | 2/2004 |
| JP | 3523505 | 2/2004 |
| JP | 2004-226746 | 8/2004 |
| JP | 3837246 | 8/2006 |
| JP | 2006-349701 | 12/2006 |

OTHER PUBLICATIONS

U.S. Appl. No. 12/007,681, filed Jan. 14, 2008.
U.S. Appl. No. 12/071,338, filed Feb. 20, 2008.
U.S. Appl. No. 12/010,799, filed Jan. 30, 2008.
U.S. Appl. No. 12/142,354, filed Jun. 19, 2008, Mitsutoshi Kichise et al.
U.S. Appl. No. 12/135,490, filed Jun. 9, 2008, Takafumi Miyazaki et al.
Office Action issued Nov. 1, 2011, in Japanese Patent Application No. 2007-184988.
Office Action issued Aug. 31, 2011, in Chinese Patent Application No. 2008101360668 with English translation.
Office Action issued May 8, 2012 in Japanese Patent Application No. 2007-265863 filed Oct. 11, 2007.

* cited by examiner

BELT DEVICE AND IMAGE FORMING APPARATUS

CROSS-REFERENCE TO RELATED APPLICATIONS

The present application claims priority to and incorporates by reference the entire contents of Japanese priority document 2007-184988 filed in Japan on Jul. 13, 2007, and 2007-265863 filed in Japan on Oct. 11, 2007.

BACKGROUND OF THE INVENTION

1. Field of the Invention

The present invention relates to a belt device used in an image forming apparatus, such as a copier, a printer, and a facsimile machine, and more particularly, to a belt device including a belt used as an intermediate transfer unit and an image forming apparatus including the belt device.

2. Description of the Related Art

In a typical image forming apparatus, such as a printer, a copier, a facsimile machine, and a printing press, an endless belt is used as a latent-image carrier, an image transfer medium, or a conveying member for conveying a recording medium such as a recording sheet.

Such an endless belt is generally supported by a plurality of rollers, and is driven to move in a predetermined direction by any one of the rollers.

Namely, the endless belt moves by having frictional contact with the rollers. While the belt is moving, it may happen that the belt meanders due to a friction acting in an axial direction of the rollers, a tilt of an axis line, or the like. In this case, the meandering of the belt means that the belt moves by being biased toward either one side of the belt in a width direction, which is parallel to the axial direction of the rollers.

When a full-color image is formed by a color image forming apparatus employing an intermediate transfer method, a plurality of different color toner images are sequentially transferred onto an intermediate transfer belt in a superimposed manner. However, if the intermediate transfer belt meanders, the toner images cannot be transferred onto a predetermined transfer position on the intermediate transfer belt, and thus an error such as a color registration error occurs in a formed image.

To prevent such a meandering of a belt, various methods have been developed. For example, in a conventional technology disclosed in Japanese Patent No. 3523503, a blocking member is integrally fixed to a rear surface of a belt at a position close to an end face of a roller. If the belt meanders, the blocking member collides with the end face of the roller. Therefore, it is possible to prevent the belt from being biased toward either one side in the width direction.

Furthermore, for example, in conventional technologies disclosed in Japanese Patent Application Laid-open No. H05-204199, Japanese Patent Application Laid-open No. 2004-226746, and Japanese Patent Application Laid-open No. H11-161055, in addition to the blocking member as described above, a belt is configured to be pressed so that the belt can be prevented from being biased toward either one side in the width direction.

Moreover, for example, in conventional technologies disclosed in Japanese Patent No. 3223771 and Japanese Patent Application Laid-open No. H05-134486, instead of such a blocking member, a flange is provided on both end faces of a roller in the axial direction so as to prevent a meandering of a belt.

Furthermore, it has been recognized that, in an image forming apparatus employing an intermediate transfer method, a range where a color registration error occurs in a transfer process can be reduced by an increase of a tension of an intermediate transfer belt. This is because a frictional force generated between a drive roller and the intermediate transfer belt increases with the increase of the belt tension. Therefore, in conventional technologies, to ensure a sufficient belt tension, such a tension roller that a spring is attached to both ends thereof is pressed against a belt.

In this method, however, with the increase of the belt tension, it may easily cause such problems that the belt has a crack on its end portion or the belt is curled up. In addition, a lateral deviation of the belt tension may occur due to a tolerance of a spring tension of each of the springs.

For example, it can be said that there is a difference in a belt tension between an intermediate transfer belt tensed by a tension roller that a spring having a spring tension of an upper limit tolerance is attached to both ends thereof and an intermediate transfer belt tensed by a tension roller that a spring having a spring tension of a lower limit tolerance is attached to both ends thereof. Furthermore, when a spring having a spring tension of an upper limit tolerance is attached to one end of a tension roller and a spring having a spring tension of a lower limit tolerance is attached to the other end of the tension roller, a lateral deviation in a belt tension occurs. A spring has a spring tension of a higher tolerance with an increase of spring pressure in general. Therefore, even when it is possible to ensure a high belt tension with preventing an occurrence of a crack on an end portion of the belt or curling of the belt, for example, by the application of pressure/depressure, there is still a possibility of an occurrence of a considerable lateral deviation in a belt tension because the belt tension is obtained by the spring pressure. Moreover, if a displacement of the belt in the width direction or a bias (a meandering) of the belt occurs while the belt is moving, it may cause damage to the end portion of the belt, and thus a belt device including the belt or an image forming apparatus including the belt device may fail to ensure a sufficient durability.

To solve the above problems, for example, in a transfer device disclosed in Japanese Patent No. 3523503, a transfer belt is an endless belt supported by rollers, and moves to a transfer position where a toner image formed on an image carrier is to be transferred in accordance with rotation of the rollers. In the transfer device, as described above, to prevent a meandering of the transfer belt, the blocking member is provided on both end portions of the rear surface of the transfer belt so that the blocking members are guided by the end faces of the rollers. In addition, an electric resistance of each of the blocking members is set up to be identical to that of a transfer unit. Furthermore, in an endless belt type carrying device disclosed in Japanese Patent No. 3223771, a plurality of roller members other than a drive roller are configured to be tiltable. Therefore, a belt walk can be corrected in such a manner that a contact pressure of each of the roller members with respect to an endless belt is biased toward either one side in an axial direction of the roller members by adjusting a tilting angle of each of the roller members. Moreover, in an endless belt disclosed in Japanese Patent No. 3837246, a guide member is provided on the endless belt. When the endless belt meanders, the guide member is struck on an end face of a belt supporting roller or a flange provided on the end face of the belt supporting roller. Therefore, it is possible to prevent the endless belt from meandering.

However, in the transfer device disclosed in Japanese Patent No. 3523503, it is necessary to install the blocking members on the rear surface of the belt having difficulty in being handled, so that the productivity is decreased. In addition, it is necessary to form a guide groove for each of the blocking members, which are relatively thick, on each of supporting rollers that respectively support the belt. Therefore, a diameter of each of the supporting rollers is increased, and thus a size of the entire apparatus is also increased. In the endless belt type carrying device disclosed in Japanese Patent No. 3223771, it is necessary to provide a belt-meandering detecting unit, a roller-tilt correcting unit, and the like. Therefore, a configuration of the device becomes complicated, and a production cost and a size of the entire apparatus are increased. In the endless belt disclosed in Japanese Patent No. 3837246, an excess bias force in the width direction of the endless belt is generated due to, for example, a positional tolerance among the supporting rollers, a deviation of a belt tension in a direction of an axis line of the endless belt, and a deviation of a friction coefficient among the supporting rollers. Therefore, it is difficult to keep preventing a buckling distortion of an end portion of the belt stably for a long time.

Furthermore, in such a configuration that the flange is provided on both end faces of the roller in the axial direction to prevent a meandering of the belt, although it is possible to avoid an impact generated when the blocking member provided on the rear surface of the belt collides with the end face of the roller, there are other problems as follows.

If there is a positional tolerance among the rollers supporting the belt or a deviation of a tension of the belt in the axial direction of the rollers due to a tilt of an axis line of each of the rollers, an excess bias force is exerted on the belt in the width direction. Furthermore, an excess bias force is generated when each of the rollers differs in a coefficient of friction in the axial direction.

When the belt is excessively biased in the width direction, and struck on the flange, the belt is buckled. If such a state that the belt is buckled is continued for a long time, the durability of the belt is impaired. It is possible to use a high stiffness belt in consideration of the durability of the belt; however, a cost increases in this case.

Moreover, the above problems can be solved by an installation of a pressing member. With only the pressing member, it is possible to downsize the apparatus and reduce a cost without decreasing the productivity. However, in this case, it may cause such a problem that a toner leaking from an end portion of a cleaning unit for cleaning an intermediate transfer belt is deposited on the pressing member, and the deposited toner is scattered inside the apparatus. Consequently, an energization error may arise because inside the apparatus including the intermediate transfer belt is stained with the scattered toner, or the image forming apparatus may fail to control an image density or an image forming process because a light receiving unit of a toner-mark sensor is stained with the scattered toner.

SUMMARY OF THE INVENTION

It is an object of the present invention to at least partially solve the problems in the conventional technology.

According to an aspect of the present invention, there is provided a belt device including a belt that is supported by a plurality of rollers and is driven to move in a predetermined direction; a flange member configured to make contact with a portion of an edge surface of the belt in its width direction; and a pressing member that presses on a surface of the belt in its thickness direction at a position near a contact portion of the belt with the flange member.

Furthermore, according to another aspect of the present invention, there is provided an image forming apparatus including a belt device that includes a belt that is supported by a plurality of rollers and is driven to move in a predetermined direction; a flange member configured to make contact with a portion of an edge surface of the belt in its width direction; and a pressing member that presses on a surface of the belt in its thickness direction at a position near a contact portion of the belt with the flange member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
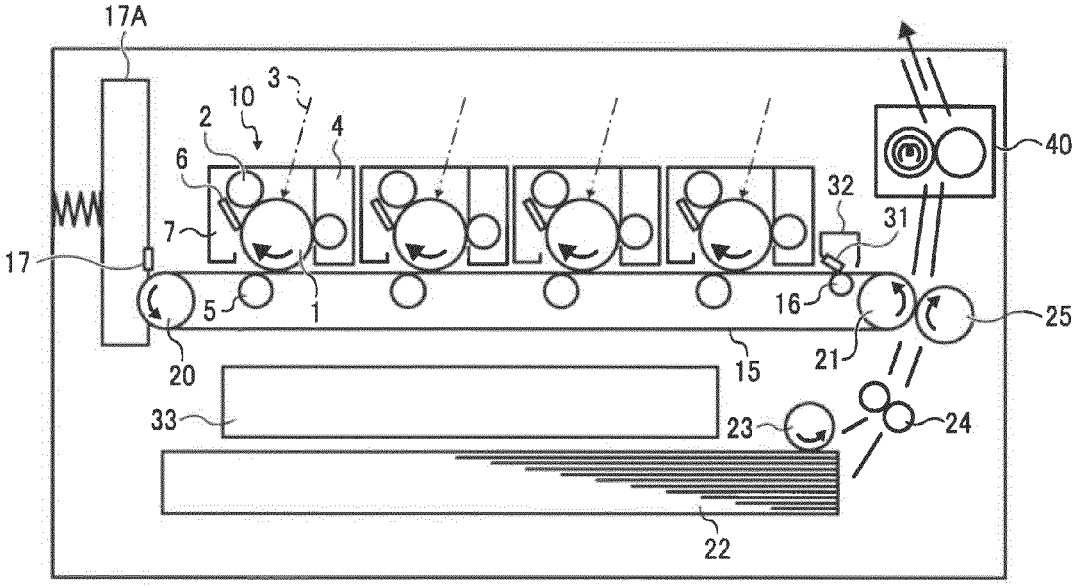
FIG. 1 is a side view of an image forming apparatus including a belt device according to a first embodiment of the present invention.

FIG. 1 is a side view of a full-color image forming apparatus including a belt device according to a first embodiment of the present invention. The image forming apparatus uses a belt as a transfer medium. A plurality of different color toner images are sequentially transferred onto the belt in a superimposed manner, and thereby forming a full-color image.

In FIG. 1, reference numeral 1 denotes a cylindrical photosensitive drum as a latent image carrier. The photosensitive drum 1 is 24 millimeters (mm) in diameter, and rotates at a circumferential speed of 120 mm/s.

Reference numeral 2 denotes a roller-shaped charging unit. The charging unit 2 is pressed against a surface of the photosensitive drum 1. The charging unit 2 rotates in accordance with rotation of the photosensitive drum 1.

A direct current (DC) bias or a DC bias on which an alternating current (AC) is superimposed is applied to the charging unit 2 by a high-voltage power supply (not shown), whereby the photosensitive drum 1 is uniformly charged at a surface potential of −500 volts (V).

After the photosensitive drum 1 is uniformly charged, an exposure unit 3 as a latent-image forming unit exposes the surface of the photosensitive drum 1 to a laser light corresponding to image data, and thereby forming an electrostatic latent image on the photosensitive drum 1.

As the exposure unit 3, a laser beam scanner using a laser diode (LD) or a light-emitting diode (LED) is used.

In FIG. 1, reference numeral 4 denotes a single-component contact developing unit. A predetermined developing bias is applied to the developing unit 4 by a high-voltage power supply (not shown). With the developing bias, the developing unit 4 develops the electrostatic latent image formed on the photosensitive drum 1 into a toner image. In the present embodiment, a single-component toner of 180 grams (g) is initially contained in the developing unit 4.

Alternatively, it is also possible to use a two-component developing unit or a non-contact developing unit.

In FIG. 1, reference numeral 10 denotes a process unit in which the photosensitive drum 1, the charging unit 2, and the developing unit 4 are integrally included.

In the image forming apparatus, the four process units 10 are arranged in parallel with one another. The process units 10 respectively form black (K), yellow (Y), magenta (M), and cyan (C) toner images when a full-color image is to be formed. The K, Y, M, and C toner images formed on the photosensitive drums 1 by the process units 10 are sequentially transferred onto an intermediate transfer belt 15, which has contact with the photosensitive drums 1, in this order in a superimposed manner, and thereby forming a full-color image.

The intermediate transfer belt 15 is supported by a secondary-transfer drive roller 21, a metallic cleaning roller 16, four primary-transfer rollers 5, and a tension roller 20. When the drive roller 21 is driven to rotate by a drive motor (not shown), the intermediate transfer belt 15 moves in accordance with the rotation of the drive roller 21. Incidentally, to apply a tension to the intermediate transfer belt 15, an elastic member (not shown) such as a spring is provided to both ends of the tension roller 20 in an axial direction, so that an elastic force in a direction of tensing the intermediate transfer belt 15 is generated by the elastic members.

Figure 2:
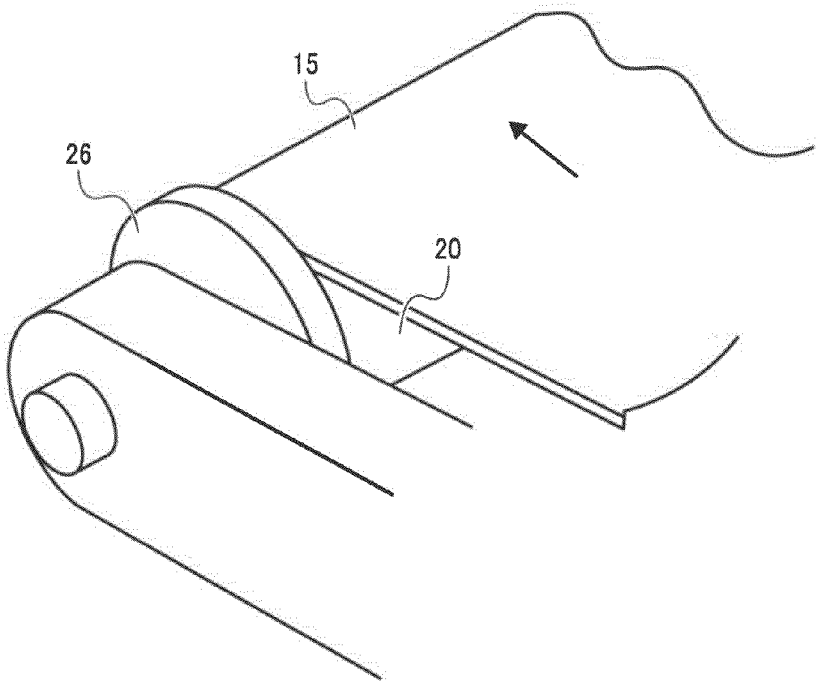
FIG. 2 is a partial perspective view of the belt device shown in FIG. 1 for explaining an example of a belt-meandering preventing mechanism.
Figure 3:
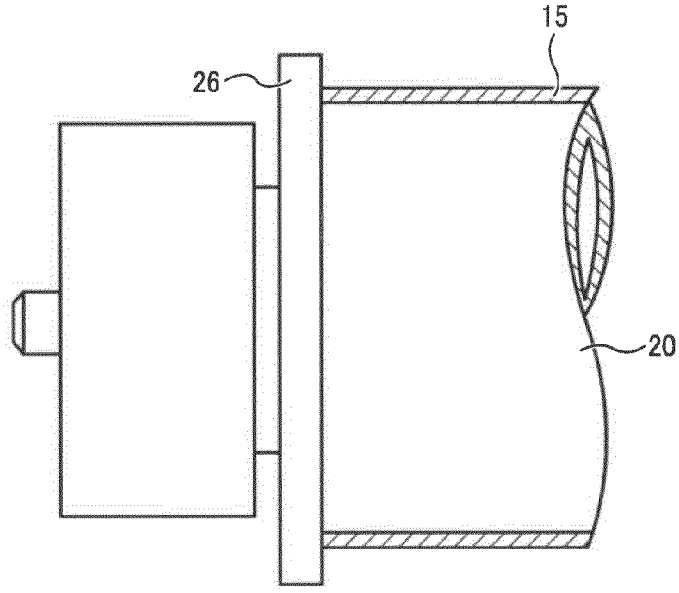
FIG. 3 is a partial front view of the belt device shown in FIG. 2.

The tension roller 20 is a pipe-shaped aluminum roller of 19 mm in diameter and 231 mm in width. As shown in FIGS. 2 and 3, a flange 26 of 22 mm in diameter, which is larger than the external diameter of the tension roller 20, is press-fitted on both end faces of the tension roller 20. If the intermediate transfer belt 15 meanders, an edge surface of the intermediate transfer belt 15 in the width direction is struck on any of the flanges 26, and thereby preventing the meandering of the intermediate transfer belt 15. Incidentally, the intermediate transfer belt 15 moves in a direction of an arrow shown in FIG. 2.

As the drive roller 21, for example, a roller made of polyurethane rubber (0.3 mm to 1 mm in thickness) or a roller coated with a thin layer (0.03 mm to 0.1 mm in thickness) can be used. In the present embodiment, a roller coated with urethane (0.05 mm in thickness) (19 mm in diameter) is used as the drive roller 21 because a diameter change with the temperature is small.

As the primary-transfer roller 5, for example, a conductive blade, a conductive sponge roller, or a metal roller can be used. In the present embodiment, a metal roller of 8 mm in diameter is used as the primary-transfer roller 5. Each of the primary-transfer rollers 5 is arranged to be opposed to the corresponding photosensitive drum 1 across the intermediate transfer belt 15 in such a manner that a center axis of the primary-transfer roller 5 is shifted from that of the photosensitive drum 1 by 8 mm in a moving direction of the intermediate transfer belt 15, and a top portion of the primary-transfer roller 5 is shifted upward by 1 mm from a bottom portion of the photosensitive drum 1 in a vertical direction.

A predetermined transfer bias of +500 V to +1000 V is applied to each of the primary-transfer rollers 5, which is opposed to the corresponding photosensitive drum 1 across the intermediate transfer belt 15, in common by a single high-voltage power supply (not shown). By the application of the transfer bias, a transfer electric field is formed between each of the primary-transfer rollers 5 and each of the photosensitive drums 1 via the intermediate transfer belt 15. As a result, the toner image formed on each of the photosensitive drums 1 is electrostatically transferred onto the intermediate transfer belt 15.

As shown in FIG. 1, the image forming apparatus further includes a toner-mark detecting sensor 17. The toner-mark detecting sensor 17 detects a toner mark formed on the intermediate transfer belt 15. The toner mark is used for checking a toner concentration or determining a transfer position. The toner-mark detecting sensor 17 is a specular reflective optical sensor or a diffuse reflective optical sensor, and is installed on a toner-mark detecting sensor installation member 17A arranged near the tension roller 20. Depending on a result of the detection by the toner-mark detecting sensor 17, an image density or a color registration (a position alignment) is controlled.

In FIG. 1, reference numeral 32 denotes an intermediate-transfer-belt cleaning unit. The intermediate-transfer-belt cleaning unit 32 includes a cleaning blade 31, and cleans the intermediate transfer belt 15 by scraping off a transfer residual toner from the intermediate transfer belt 15 with the cleaning blade 31.

In the present embodiment, as the cleaning blade 31, a blade made of polyurethane rubber having a thickness of 1.5 mm to 3 mm and a rubber hardness of 65 degrees to 80 degrees is used. The cleaning blade 31 is arranged to be in contact with the intermediate transfer belt 15 in a counter direction to the moving direction of the intermediate transfer belt 15. The scraped transfer residual toner is contained in a waste toner container 33 through a waste toner path (not shown).

At the time of assembling the image forming apparatus, a lubricant such as zinc stearate is applied to at least any one of a portion of the cleaning blade 31 corresponding to a cleaning nip portion of the intermediate transfer belt 15 formed between the cleaning blade 31 and the cleaning roller 16 and an edge portion of the cleaning blade 31. Therefore, it is possible to prevent the cleaning blade 31 from being ridden up at the cleaning nip portion. In addition, a dam layer is formed by the lubricant at the cleaning nip portion, so that the cleaning performance can be improved.

Both end faces of the rollers supporting the intermediate transfer belt 15 are supported by side plates (not shown) from both sides of the edges of the intermediate transfer belt 15, respectively.

As the intermediate transfer belt 15, an endless belt made of a resin film in which a conductive material such as carbon black is dispersed in, for example, polyvinylidine difluoride (PVDF), ethylen etetrafluoroeyhylene (ETFE), poryimide (PI), polycarbonate (PC), thermoplastic elastomer (TPE), and the like can be used. In the present embodiment, a belt that has a single layer structure in which carbon black is added to TPE having modulus of elongation of 1000 MPa to 2000 MPa, a thickness of 90 micrometers (μm) to 160 μm, and a width of 230 mm is used as the intermediate transfer belt 15.

Under the conditions of a temperature of 23° C. and 50% relative humidity, a volume resistivity of the intermediate transfer belt 15 is preferably in a range of $10^8$ Ω·cm to $10^{11}$ Ω·cm, and a surface resistivity of the intermediate transfer belt 15 is preferably in a range of $10^8$ O/sq to $10^{11}$ O/sq (both measurements are made at an applied voltage of 500 V for an application time of 10 seconds with Hiresta-UP MCP-HT450 manufactured by Mitsubishi Chemical Corporation).

When both the volume resistivity and the surface resistivity of the intermediate transfer belt 15 exceed the above ranges, the intermediate transfer belt 15 is charged. Therefore, as the intermediate transfer belt 15 moves toward the downstream side of which the toner images are sequentially transferred onto the intermediate transfer belt 15, a higher preset voltage needs to be set. Thus, it is difficult for the single high-voltage power supply to supply an appropriate voltage to each of the primary-transfer rollers 5. This is because a charged potential of the surface of the intermediate transfer belt 15 is increased by an electric discharge occurring in the transfer process or the transfer-medium separating process, so that the intermediate transfer belt 15 has difficulty in a self-discharge. To cope with this matter, it is necessary to provide an electricity removing unit that removes an electricity from the intermediate transfer belt 15. On the other hand, when both the volume resistivity and the surface resistivity of the intermediate transfer belt 15 drop below the above ranges, a decrease of the charged potential is accelerated, so that the intermediate transfer belt 15 has no difficulty in the self-discharge. However, in this case, a toner is scattered due to a flow of a current in a surface direction when a toner image is transferred onto the intermediate transfer belt 15. Therefore, the volume resistivity and the surface resistivity of the intermediate transfer belt 15 are preferably within the above ranges.

In FIG. 1, reference numeral 25 denotes a secondary-transfer roller. The secondary-transfer roller 25 is a roller that a metal cored bar of 6 mm in diameter, which is made by, for example, steel use stainless (SUS), is coated with an elastic medium such as urethane adjusted to have a resistance in a range of $10^6$ O to $10^{10}$ O by a conductive material so that the secondary-transfer roller 25 is formed to have a diameter of 19 mm and a width of 222 mm. Specifically, an ion-conductive roller (made by urethane in which carbon is dispersed, acrylonitrile butadiene rubber (NBR), and hydrin), an electronically conductive roller (made by ethylene propylene dieneterpolymers (EPDM)), or the like can be used as the secondary-transfer roller 25. In the present embodiment, a urethane roller having an Asker C hardness of 35 degrees to 50 degrees and a diameter of 19 mm is used as the secondary-transfer roller 25. When a resistance of the secondary-transfer roller 25 exceeds the above range, it is difficult to flow a sufficient current into the secondary-transfer roller 25. Therefore, to obtain a sufficient transfer efficiency, it is necessary to apply a higher voltage to the secondary-transfer roller 25, and thus a cost of power supply is increased. In addition, by the application of the higher voltage, an electric discharge occurs in a space around a transfer nip portion, so that a white spot is generated on a halftone image due to the electric discharge. Such a defect occurs prominently in the conditions of low temperature and low humidity (for example, in the conditions of a temperature of 10° C. and 15% relative humidity). On the other hand, when a resistance of the secondary-transfer roller 25 drops below the above range, it is not possible to achieve sufficient transfer efficiencies for both a color image (such as superimposed three-color toner images) and a monochrome image to be formed on the same sheet. This is because the resistance of the secondary-transfer roller 25 is low, so that a sufficient current for the transfer of the monochrome image requiring a relatively low voltage can be flown. However, the transfer of the color image requires a higher voltage than the voltage appropriate to the monochrome image. If a voltage is set to be appropriate to the color image, an excess current for the transfer of the monochrome image is flown, and thereby causing a decrease of the transfer efficiency for the monochrome image.

Incidentally, a resistance of the secondary-transfer roller 25 is measured in such conditions that the secondary-transfer roller 25 is installed on a conductive metal plate, and a load of 4.9 N is applied to both ends of the cored bar. The resistance of the secondary-transfer roller 25 is obtained based on a current flown thereinto when a voltage of 1 kV is applied to a portion between the cored bar and the metal plate.

A transfer medium 22 such as a sheet is contained in a containing unit such as a sheet cassette. The transfer medium 22 is fed from the containing unit by a sheet feed roller 23 and a pair of registration rollers 24 in synchronization with a timing at which a leading end of the toner image formed on the surface of the intermediate transfer belt 15 comes to a secondary transfer position. A predetermined transfer bias is applied to the transfer medium 22 by a high-voltage power supply (not shown), whereby the toner image is transferred from the intermediate transfer belt 15 onto the transfer medium 22. The image forming apparatus according to the present embodiment employs a longitudinally-extending path as a sheet path. The transfer medium 22 is separated from the intermediate transfer belt 15 by the use of the curvature of the secondary-transfer drive roller 21. After the toner image transferred onto the transfer medium 22 is fixed thereon by a fixing unit 40, the transfer medium 22 is discharged from the image forming apparatus.

In the present embodiment, the fixing unit 40 is configured to change a processing speed depending on a type of the transfer medium 22. Specifically, when the transfer medium 22 has a basis weight of 100 g/m$^2$ or more, the processing speed is reduce by half as compared with a normal processing speed. Namely, it takes the transfer medium 22 twice as long to pass through a fixing nip formed between a pair of fixing rollers included in the fixing unit 40 as compared with a case of the normal processing speed. Therefore, the toner image can be reliably fixed on the transfer medium 22.

In the image forming apparatus with such a configuration, when the intermediate transfer belt 15 meanders, the edge surface of the intermediate transfer belt 15 in the width direction is struck on any of the flanges 26 provided on the end faces of the tension roller 20. Therefore, it is possible to prevent the meandering of the intermediate transfer belt 15. In the present embodiment, a buckling-distortion preventing mechanism is provided to prevent a buckling distortion of the intermediate transfer belt 15 that may occur when the edge surface of the intermediate transfer belt 15 is struck on the flange 26.

Figure 4:
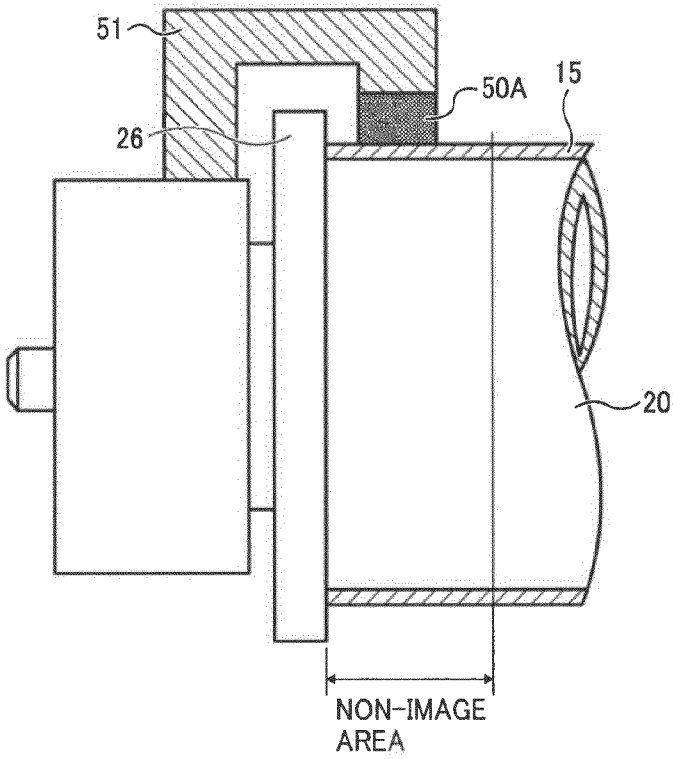
FIG. 4 is a partial front view of the belt device for explaining a buckling-distortion preventing mechanism provided to the belt device shown in FIG. 3.

FIG. 4 is a partial front view of the belt device for explaining the buckling-distortion preventing mechanism. As the buckling-distortion preventing mechanism, a pressing member 50A supported by a holder 51 is provided at a position near a portion of the intermediate transfer belt 15 in abutting contact with the flange 26. The pressing member 50A presses on the intermediate transfer belt 15 in a thickness direction of the intermediate transfer belt 15 from the side of the front surface of the intermediate transfer belt 15 (i.e., the side of the surface of the intermediate transfer belt 15 opposed to the photosensitive drums 1), and thereby preventing an occurrence of an undulation of the intermediate transfer belt 15.

The pressing member 50A is arranged outside of an image forming area along a width direction of the intermediate transfer belt 15, which is parallel to an axial direction of the tension roller 20. Specifically, the pressing member 50A is arranged so that the pressing member 50A can press on the intermediate transfer belt 15 at the position near a portion of the edge surface of the intermediate transfer belt 15 in abutting contact with the flange 26.

The pressing member 50A is composed of a slidable member allowing the intermediate transfer belt 15 to move smoothly even when the pressing member 50A presses on the surface of the intermediate transfer belt 15. The pressing member 50A is made of resin having a sliding property, such as sliding polyoxymethylene (POM) and sliding acrylonitrile butadiene styrene (ABS), a sliding sponge, felt, or the like. A horizontal width of a pressing surface of the pressing member 50A to be pressed against the intermediate transfer belt 15 in the width direction is 2 mm to 5 mm because it is necessary to save space on the intermediate transfer belt 15 for 210 mm for a horizontal width of an A4-size sheet or 216 mm for a horizontal width of a letter-size sheet.

Figure 5:
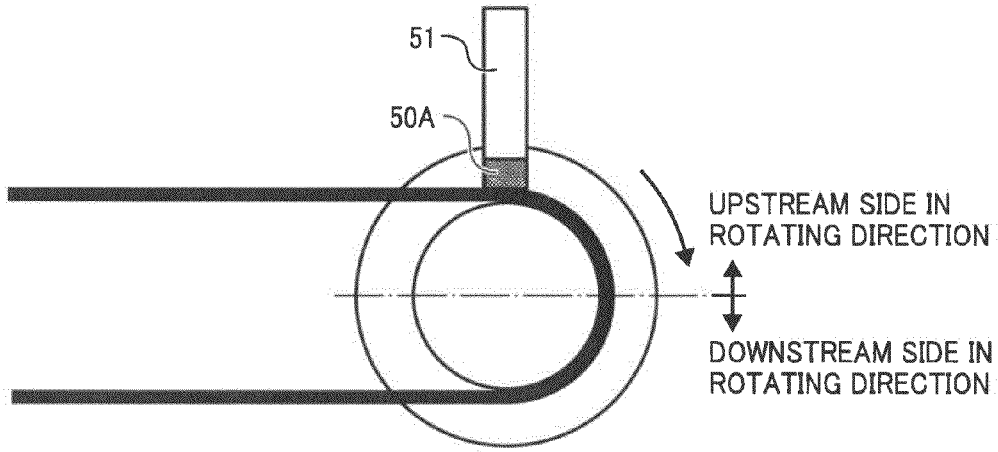
FIG. 5 is a partial side view of the belt device for explaining an installation position of a pressing member shown in FIG. 4.

As shown in FIG. 5, the pressing member 50A, which presses on the intermediate transfer belt 15 in a state where the pressing member 50A faces off against the tension roller 20 across the intermediate transfer belt 15, is arranged on the upstream side of a portion of the intermediate transfer belt 15 where the intermediate transfer belt 15 is just in contact with an outer circumferential surface of the tension roller 20 in the rotating direction of the tension roller 20. In other words, the pressing member 50A is located on the side capable of pressing on the intermediate transfer belt 15 to apply a tension to the intermediate transfer belt 15. Therefore, it is possible to prevent an occurrence of a buckling distortion of an extended surface of the intermediate transfer belt 15 where a buckling distortion tends to occur when the tension of the intermediate transfer belt 15 is changed.

Figure 6:
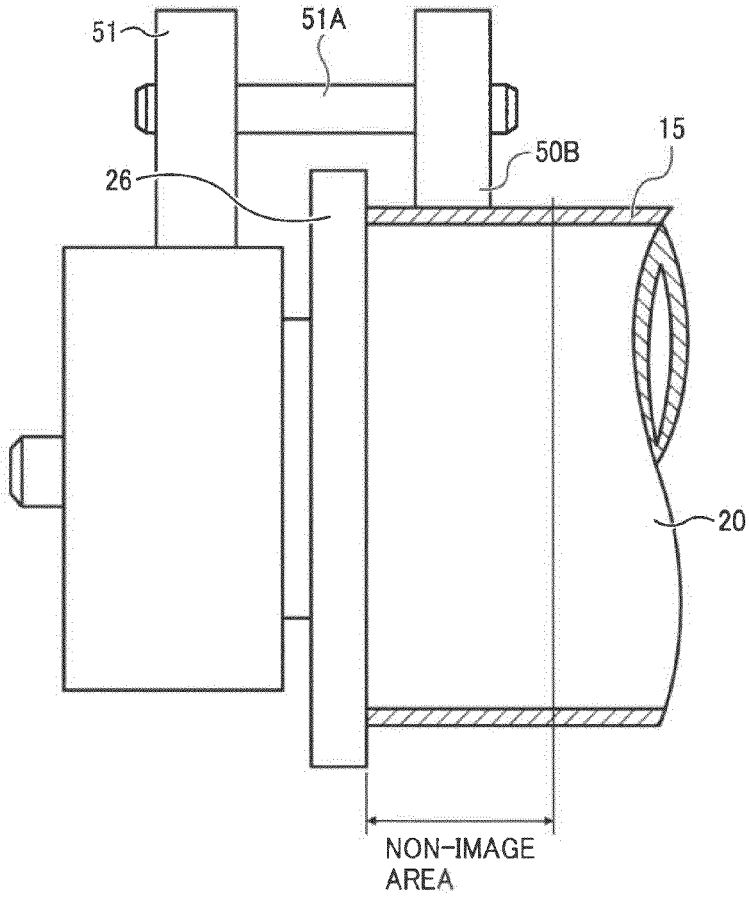
FIG. 6 is a partial front view of the belt device including a pressing member as a modified example of that is shown in FIG. 4.

FIG. 6 is a partial side view of the belt device including a pressing member 50B as a modified example of the pressing member 50A shown in FIG. 4. The pressing member 50B is composed of a roller capable of rolling with pressing on the intermediate transfer belt 15.

In the belt device shown in FIG. 6, a shaft 51A is rotatably supported by the holder 51, and penetrates through the pressing member 50B so that the pressing member 50B can roll. The pressing member 50B rolls in conjunction with the movement of the intermediate transfer belt 15. The pressing member 50B is made of resin having a high sliding property, such as sliding POM or sliding ABS, so as not to inhibit the movement of the intermediate transfer belt 15. A horizontal width of a pressing surface of the pressing member 50B in contact with the intermediate transfer belt 15 is 2 mm to 5 mm.

Figure 7:
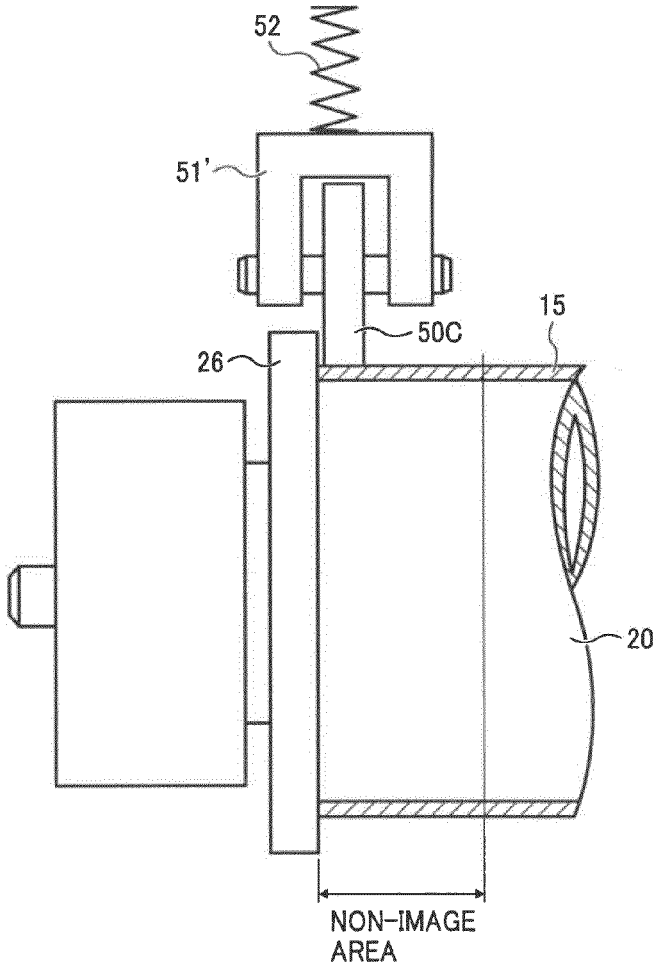
FIG. 7 is a partial front view of the belt device including a pressing member as a modified example of that is shown in FIG. 6.

FIG. 7 is a partial side view of the belt device including a pressing member 50C as a modified example of the pressing member 50B shown in FIG. 6. The pressing member 50C is composed of a roller capable of rolling with pressing on the intermediate transfer belt 15. The pressing member 50C is rotatably supported by a holder 51'. The pressing member 50C is pressed against the surface of the intermediate transfer belt 15 by the action of an elastic medium 52, such as a spring, pressing the holder 51'. The pressing member 50C is made of resin having a high sliding property, such as sliding POM or sliding ABS. A horizontal width of a pressing surface of the pressing member 50C in contact with the intermediate transfer belt 15 is 2 mm to 5 mm. The pressing member 50C is pressed against the intermediate transfer belt 15 by a pressing force of 1 N to 10 N applied by the elastic medium 52.

In this manner, in the present embodiment, the pressing member presses on the intermediate transfer belt 15 in the thickness direction from the side of the front surface of the intermediate transfer belt 15 at the position near the portion of the edge surface of the intermediate transfer belt 15 in abutting contact with the flange 26 of the tension roller 20, whereby it is possible to prevent an occurrence of a buckling distortion of the intermediate transfer belt 15 in abutting contact with the flange 26. Specifically, the pressing member does not serve to prevent an occurrence of a gap due to an uplift behavior of the intermediate transfer belt 15, but serves to prevent a buckling distortion behavior, including the uplift behavior, of the intermediate transfer belt 15. Therefore, it is possible to prevent the intermediate transfer belt 15 from a stress concentration occurring when a meandering of the intermediate transfer belt 15 in the width direction is suppressed. Thus, the durability of the intermediate transfer belt 15 can be prevented from being decreased.

The pressing member is configured to be in sliding contact with the intermediate transfer belt 15 so that the pressing member can press on the intermediate transfer belt 15 not to inhibit the movement of the intermediate transfer belt 15. Therefore, unlike such a case that the intermediate transfer belt 15 is just pressed down to prevent an uplift behavior of the intermediate transfer belt 15, it is possible to prevent the intermediate transfer belt 15 from meandering. Thus, toner images can be transferred onto the intermediate transfer belt 15 in a superimposed manner precisely, so that a defect image due to, for example, a color registration error can be prevented from occurring.

Figure 8:
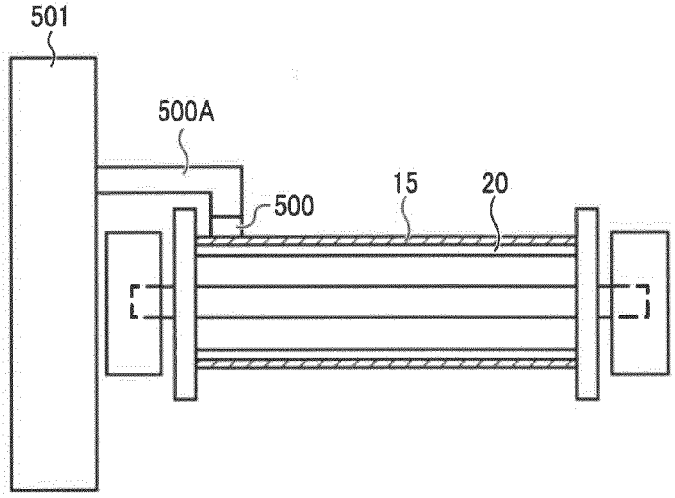
FIG. 8 is a front view of the belt device according to the first embodiment for explaining an example of a supporting structure for supporting a pressing member.

FIG. 8 is a front view of the belt device for explaining an example of a supporting structure for supporting a pressing member 500. In the example shown in FIG. 8, the pressing member 500 is supported by a holder member 500A, and the holder member 500A is attached to a fixed member 501. Incidentally, the fixed member 501 is provided separately from the tension roller 20 and the intermediate transfer belt 15.

In the present embodiment, a side plate of a main body of the image forming apparatus is used as the fixed member 501. The pressing member 500 is integrated with the holder member 500A. The holder member 500A is attached to both or either one of the side plates located in the width direction of the intermediate transfer belt 15.

A configuration of the pressing member 500 is identical to that of any of the pressing members shown in FIGS. 4 to 6. In other words, an installation position of the pressing member 500 with respect to the intermediate transfer belt 15 and a size of a pressing surface of the pressing member 500 are identical to those of any of the pressing members shown in FIGS. 4 to 6.

Figure 9:
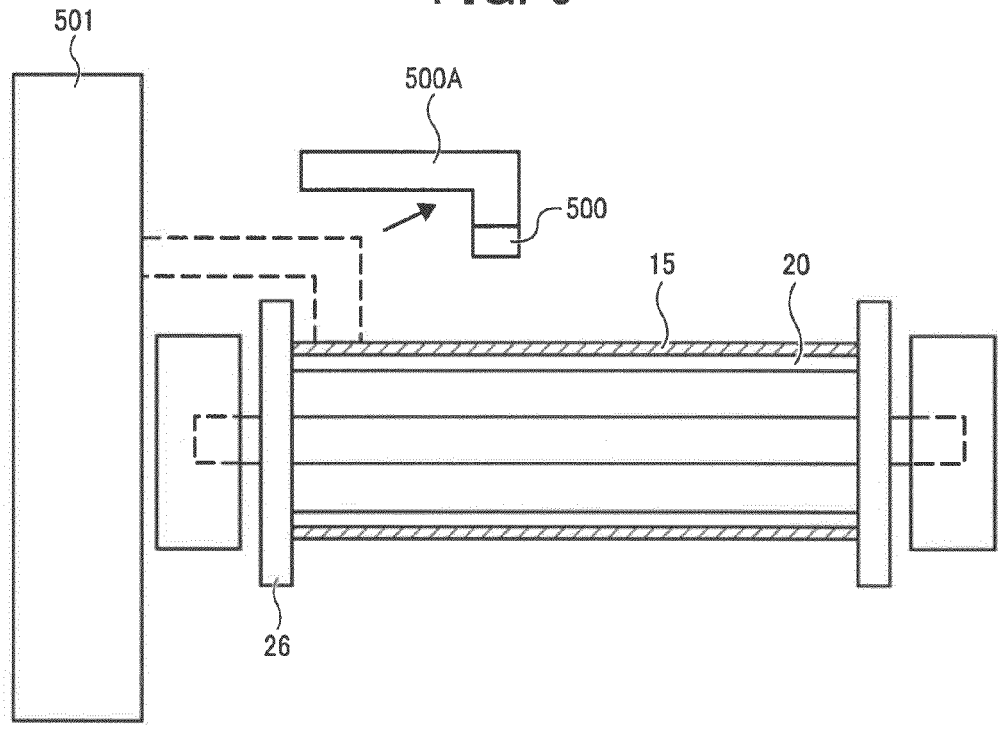
FIG. 9 is a front view of the belt device including a supporting structure as a first modified example of that is shown in FIG. 8.
Figure 10:
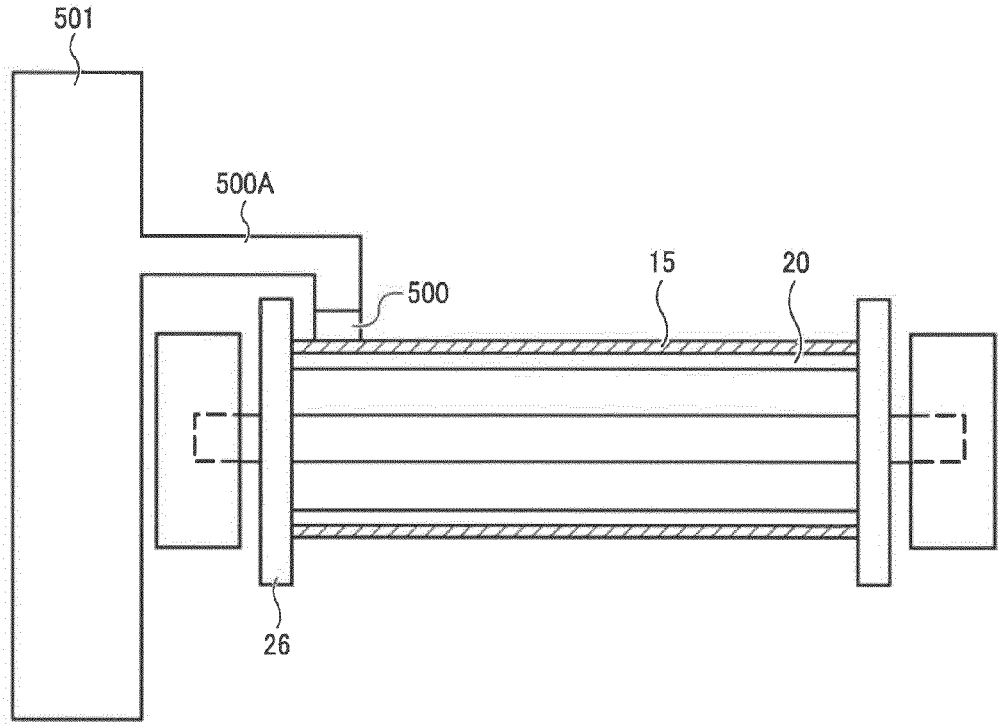
FIG. 10 is a front view of the belt device including a supporting structure as a second modified example of that is shown in FIG. 8.

Alternatively, as shown in FIG. 9, the holder member 500A can be removably attached to the fixed member 501. In other words, the pressing member 500 integrated with the holder member 500A can be moved away from the intermediate transfer belt 15. Therefore, when the pressing member 500 needs to be replaced due to wear, the holder member 500A integrated with the pressing member 500 is removed from the fixed member 501, and replaced with a new one. In other words, only a part to be replaced can be removed, so that a newly-installed part can be minimized. Thus, it is possible to reduce the production cost. Alternatively, the holder member 500A can be integrally molded with the fixed member 501 as shown in FIG. 10. In a case shown in FIG. 10, the pressing member 500 is attached to the holder member 500A. The holder member 500A is integrally molded with the fixed member 501 so that the pressing member 500 can press on the surface of the intermediate transfer belt 15. In this case, the holder member 500A and the fixed member 501 can be formed of the same material, and thus it is possible to reduce the production cost.

Figure 11:
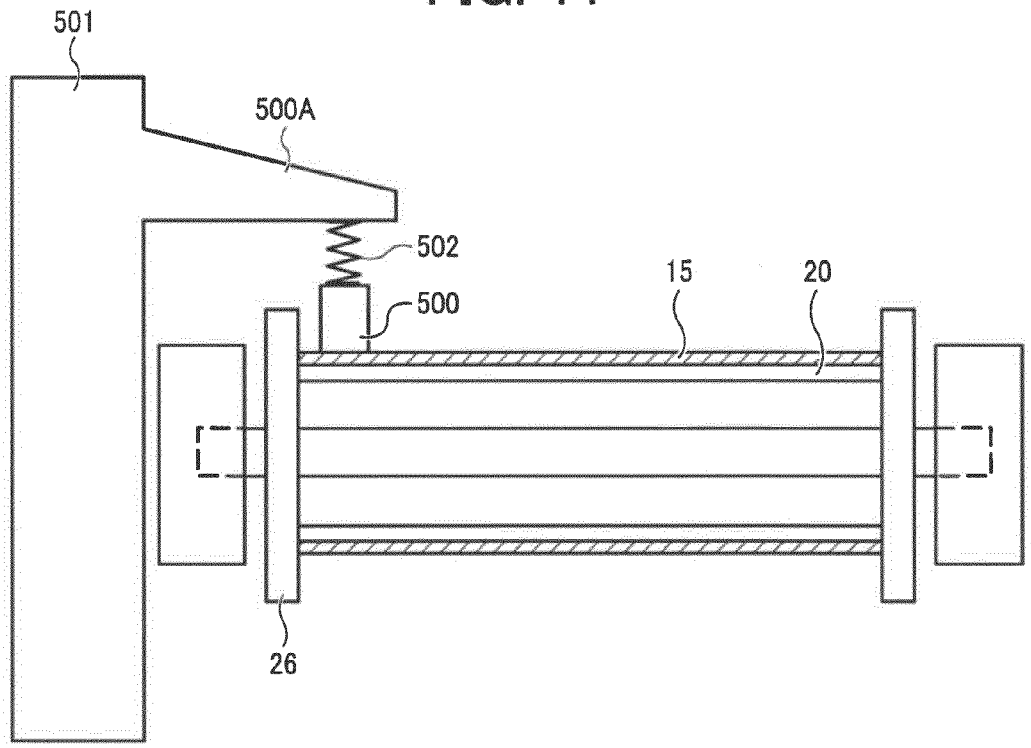
FIG. 11 is a front view of the belt device including a supporting structure as a modified example of that is shown in FIG. 10.

FIG. 11 is a front view of the belt device including a supporting structure as a modified example of the supporting structure shown in FIG. 10. In a case shown in FIG. 11, to apply pressure to the pressing member 500, an elastic member 502 such as a spring is provided between the holder member 500A and the pressing member 500. Specifically, one end of the elastic member 502 is attached to the holder member 500A that is integrally molded with the fixed member 501, and the other end of the elastic member 502 is attached to the pressing member 500. In this configuration, the pressing member 500 can be displaced in the thickness direction of the intermediate transfer belt 15. In addition, by the use of a restoring force of the elastic member 502, the pressing member 500 can constantly press on the surface of the intermediate transfer belt 15 irrespective of which a gap between the surface of the intermediate transfer belt 15 and the pressing member 500 is changed due to, for example, an eccentricity of the tension roller 20. Therefore, it is possible to prevent an occurrence of a buckling distortion of the intermediate transfer belt 15.

Figure 12:
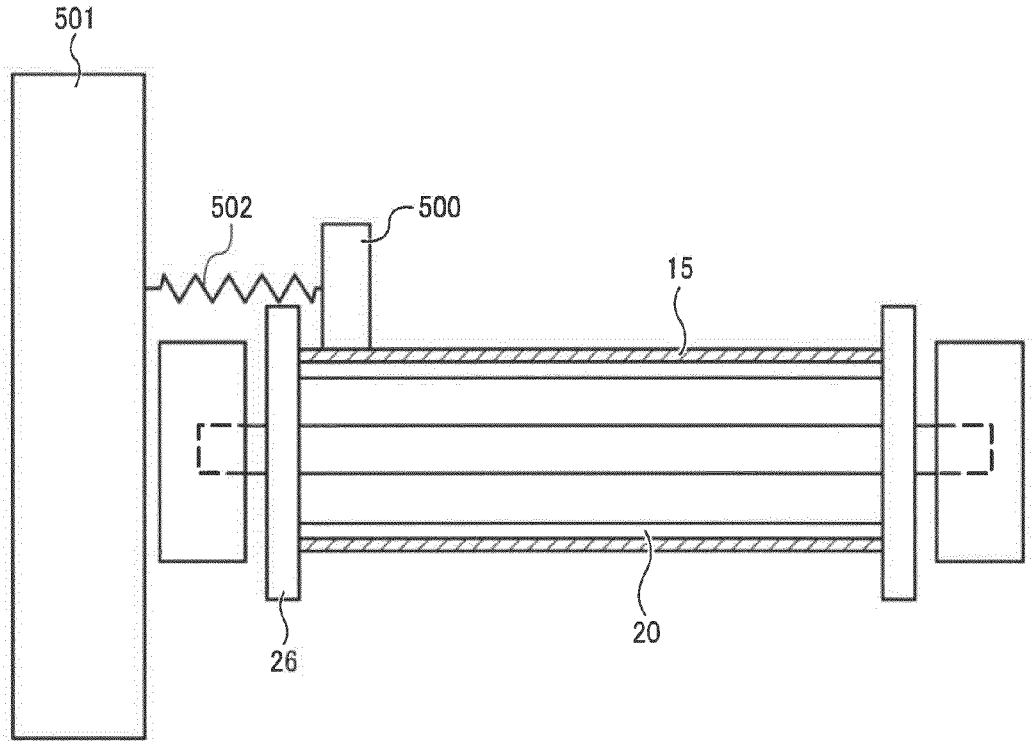
FIG. 12 is a front view of the belt device including a supporting structure as a modified example of that is shown in FIG. 11.

FIG. 12 is a front view of the belt device including a supporting structure as a modified example of that is shown in FIG. 11. In a case shown in FIG. 12, one end of the stretchable elastic member 502 is attached to the fixed member 501 direct, and the other end of the elastic member 502 is attached to the pressing member 500 in a direction perpendicular to the thickness direction of the intermediate transfer belt 15, i.e., along the axial direction of the tension roller 20. Therefore, for example, even when the tension roller 20 is displaced in the axial direction, the pressing member 500 can constantly press on the surface of the intermediate transfer belt 15 at the position near the flange 26 by the use of the restoring force of the elastic member 502.

The displacement of the tension roller 20 in the axial direction occurs under such conditions that the tension roller 20 is a rolling member, and a supporting member 20A of the tension roller 20, which is located outside the flange 26, is fixed. In this case, a slight gap is formed between the supporting member 20A and the flange 26 so that the supporting member 20A and the flange 26 do not rub against each other. When an external force generated by a meandering of the intermediate transfer belt 15 is exerted on the tension roller 20, the tension roller 20 may be displaced in the axial direction.

Even when the tension roller 20 is displaced in the axial direction, the pressing member 500 can be displaced along with the displacement of the tension roller 20 by the use of a bias force of the elastic member 502. Therefore, the pressing member 500 can be constantly located at the same position with respect to the tension roller 20. In other words, the pressing member 500 can be located at the position where a buckling distortion of the intermediate transfer belt 15 tends to occur. Thus, it is possible to prevent the buckling distortion of the intermediate transfer belt 15.

Figure 13:
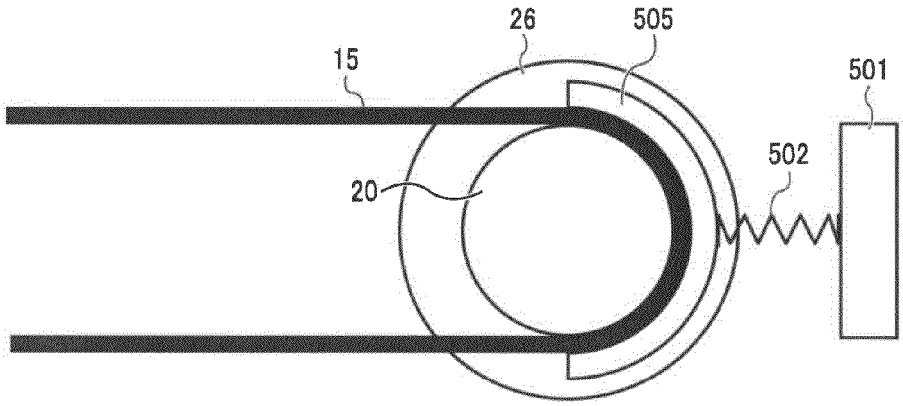
FIG. 13 is a partial side view of the belt device including a pressing member as a modified example of that is shown in FIG. 12.

FIG. 13 is a partial side view of the belt device including a pressing member as a modified example of the pressing member shown in FIG. 12. In a case shown in FIG. 13, an elastic pressing member 505 is provided instead of the pressing member 500. When the pressing member 505 is pressed against a round portion of the intermediate transfer belt 15 where the intermediate transfer belt 15 is supported by the tension roller 20 by the elastic member 502, the pressing member 505 is in elastic contact with the intermediate transfer belt 15 along a curvature of the tension roller 20. Therefore, even when a position of a shaft center of the tension roller 20 is changed to stabilize the tension of the intermediate transfer belt 15, the pressing member 505 can constantly press on a portion of the intermediate transfer belt 15 where a buckling distortion of the intermediate transfer belt 15 tends to occur in accordance with the change of the position of the shaft center of the tension roller 20. Thus, it is possible to prevent the buckling distortion of the intermediate transfer belt 15.

Figure 14:
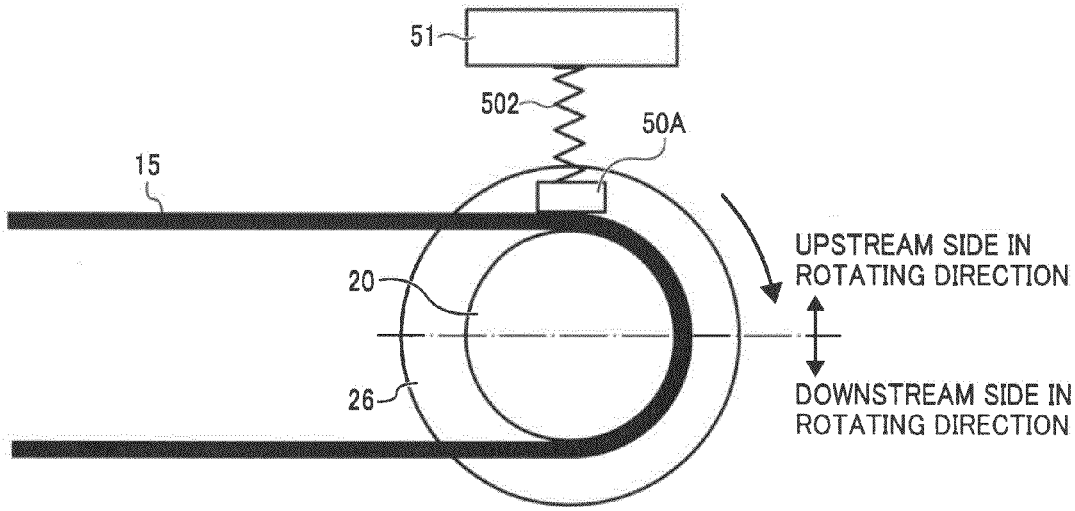
FIG. 14 is a partial side view of the belt device including a pressing member as a modified example of that is shown in FIG. 5.

FIG. 14 is a partial side view of the belt device including a pressing member as a modified example of that is shown in FIG. 5. In a case shown in FIG. 14, the pressing member 50A is not directly supported by the holder 51 but supported by the holder 51 via the elastic member 502, so that the pressing member 50A can be in elastic contact with the intermediate transfer belt 15. Therefore, in the same manner as that is shown in FIG. 5, it is possible to prevent a buckling distortion of the portion of the intermediate transfer belt 15 where a buckling distortion of the intermediate transfer belt 15 tends to occur when the tension of the intermediate transfer belt 15 is changed. Moreover, the pressing member 50A shown in FIG. 14 can keep pressing on the intermediate transfer belt 15 even when a position of the shaft center of the tension roller 20 is changed.

Figure 15:
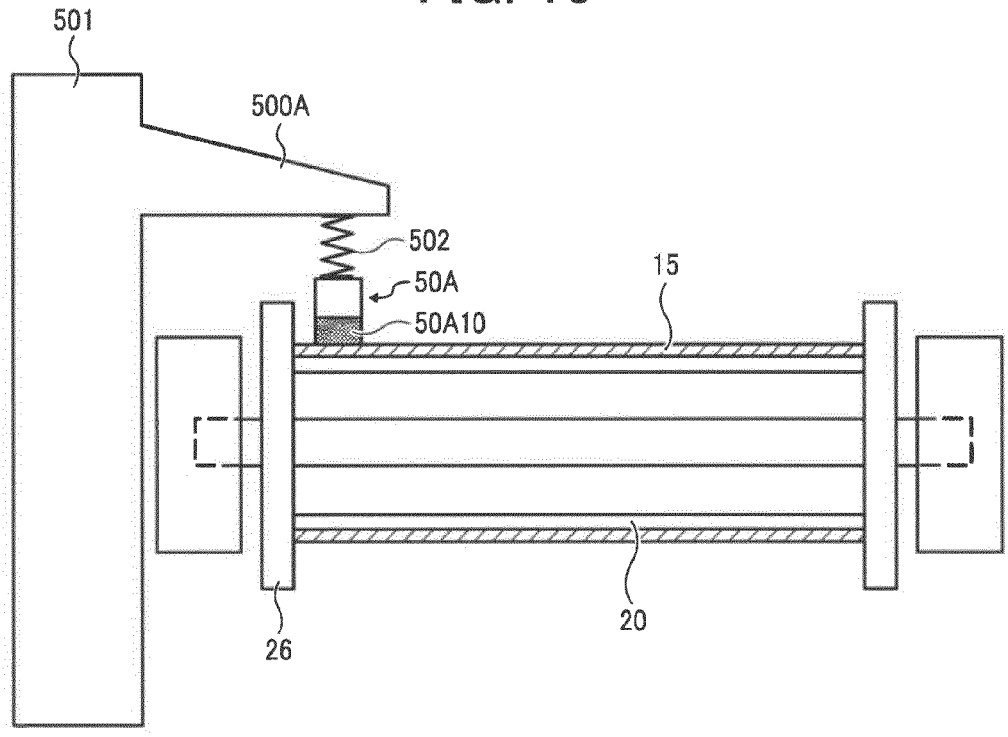
FIG. 15 is a front view of the belt device including the supporting structure shown in FIG. 11 and a pressing member as a modified example of that is shown in FIG. 14.

FIG. 15 is a front view of the belt device including the supporting structure shown in FIG. 11 and a pressing member as a modified example of that is shown in FIG. 14. In a case shown in FIG. 15, the pressing member 50A is supported by the holder member 500A, which is integrally provided on the fixed member 501, via the elastic member 502, and the pressing member 50A is in elastic contact with the intermediate transfer belt 15. A pressing surface 50A10 of the pressing member 50A on the side of pressing on the surface of the intermediate transfer belt 15 is made of a member having a sliding property, such as a sliding sponge or felt, so as not to inhibit the movement of the intermediate transfer belt 15. Therefore, a sliding resistance can be reduced, and also the surface of the intermediate transfer belt 15 can be prevented from being damaged due to contact with the pressing member 50A.

Figure 16:
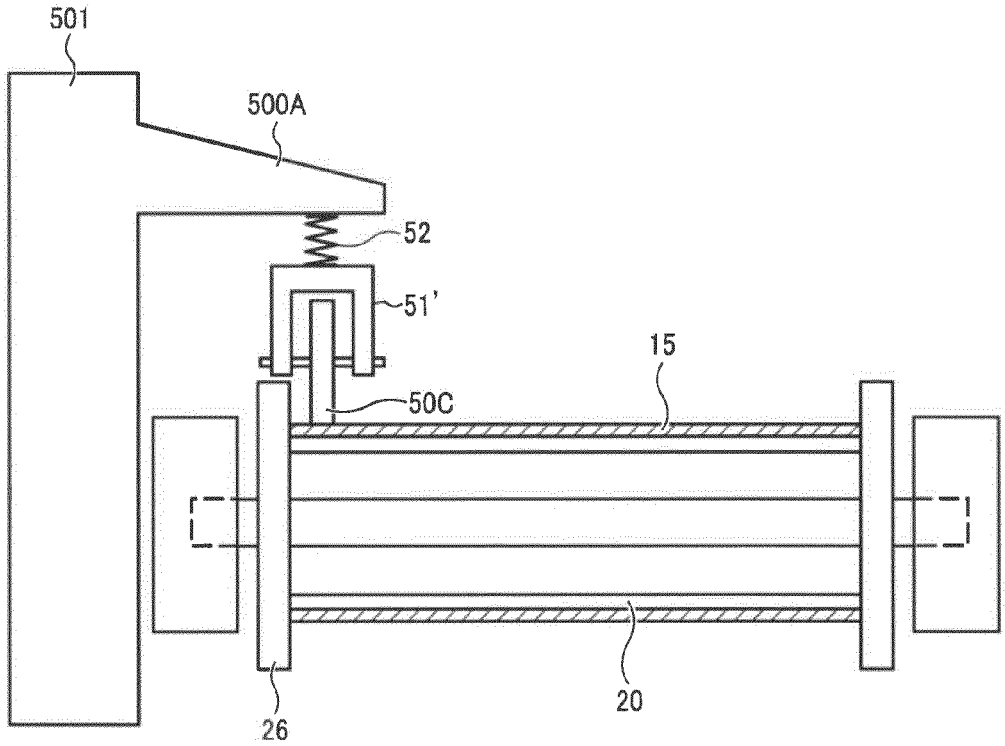
FIG. 16 is a front view of the belt device including the pressing member shown in FIG. 7 as a modified example of that is shown in FIG. 15.

FIG. 16 is a front view of the belt device including the pressing member shown in FIG. 7 as a modified example of that is shown in FIG. 15. In a case shown in FIG. 16, the pressing member 50C is composed of a roller and supported by the holder 51'. The holder 51' is hung from the holder member 500A via the elastic member 52 (corresponding to the elastic member 502 in FIG. 15). In this case, the holder 51' is configured to be capable of moving up and down. The pressing member 50C is constantly pressed against the surface of the intermediate transfer belt 15 by a bias force of the elastic member 52. Therefore, in the same manner as that is shown in FIG. 7, the pressing member 50C can roll with pressing on the surface of the intermediate transfer belt 15. Thus, it is possible to prevent deterioration and damage of the intermediate transfer belt 15.

Figure 17:
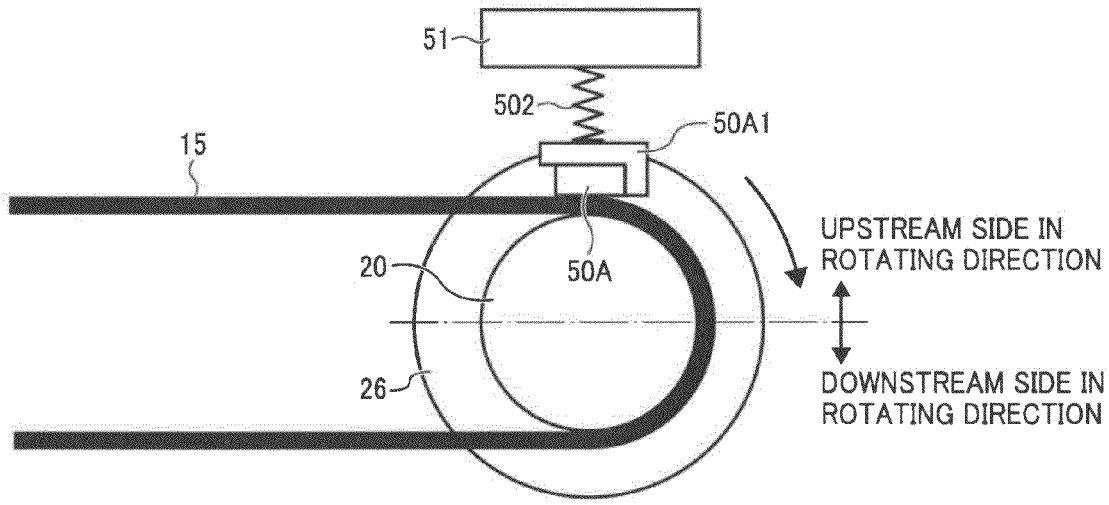
FIG. 17 is a partial side view of the belt device including a pressing member as a modified example of that is shown in FIG. 14.

FIG. 17 is a partial side view of the belt device including a pressing member as a modified example of that is shown in FIG. 14. In a case shown in FIG. 17, the pressing member 50A is latched onto a rib 50A1. A portion of the rib 50A1 projecting vertically downward on the downstream side of the pressing member 50A in the rotating direction of the tension roller 20 is in contact with the intermediate transfer belt 15. Therefore, the rib 50A1 can serve to prevent the pressing member 50A in contact with the intermediate transfer belt 15 from being displaced along with the movement of the intermediate transfer belt 15, and also serve to prevent the pressing member 50A from changing its pressing position with respect to the intermediate transfer belt 15. Thus, the pressing member 50A can constantly press on a portion of the intermediate transfer belt 15 where a buckling distortion of the intermediate transfer belt 15 tends to occur, and thereby preventing the buckling distortion of the intermediate transfer belt 15.

Figure 18A:
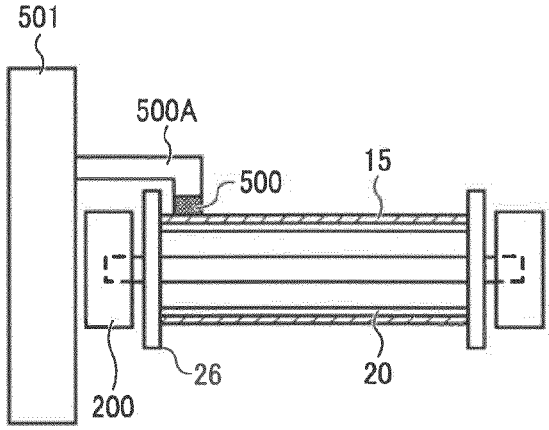
FIG. 18A is a front view of the belt device shown in FIG. 8 for explaining an installation position of a holder member supporting the pressing member.
Figure 18B:
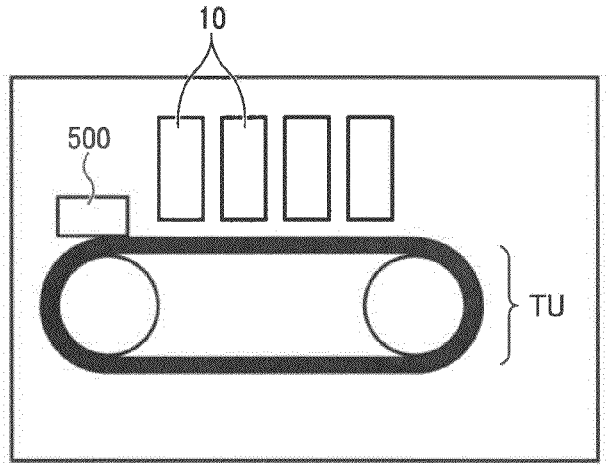
FIGS. 18B and 18C are side views of the image forming apparatus including the belt device shown in FIG. 18A for explaining a case where a unit TU is removed from the image forming apparatus.
Figure 18C:
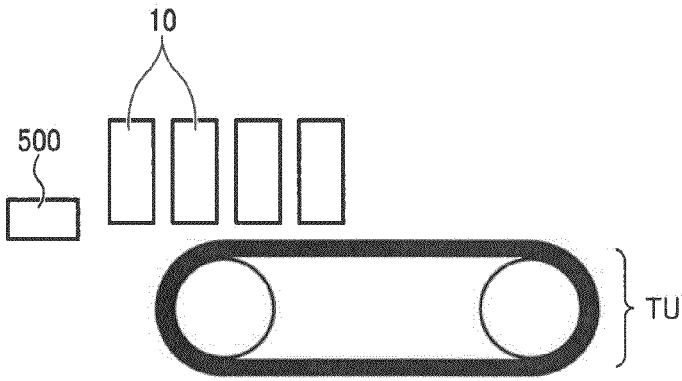

FIGS. 18A to 18C are schematic diagrams of the image forming apparatus for explaining a case where a unit TU is removed from the image forming apparatus. In this case, the holder member 500A supporting the pressing member 500 is attached to the fixed member 501. The intermediate transfer belt 15 is included in the unit TU together with the tension roller 20 and a supporting member 200 of the tension roller 20. The unit TU is removably installed in the image forming apparatus.

In this configuration, the holder member 500A supporting the pressing member 500 is attached to the fixed member 501 regardless of removal of the unit TU. Therefore, when the unit TU is removed from the image forming apparatus, as shown in FIG. 18C, the pressing member 500 does not interfere with the process units 10.

Figure 19A:
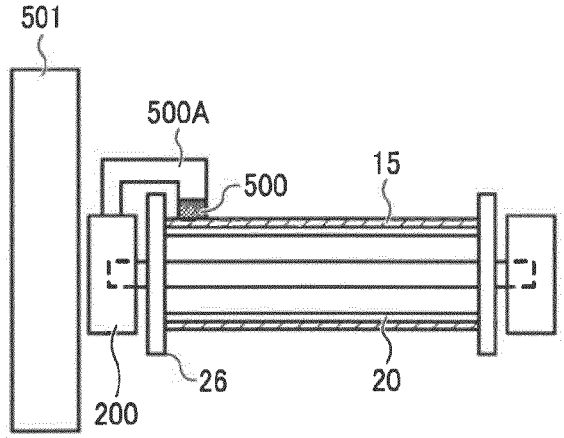
FIG. 19A is a front view of a belt device in which a holder member supporting a pressing member is attached to a different position from that is shown in FIG. 18A.
Figure 19B:
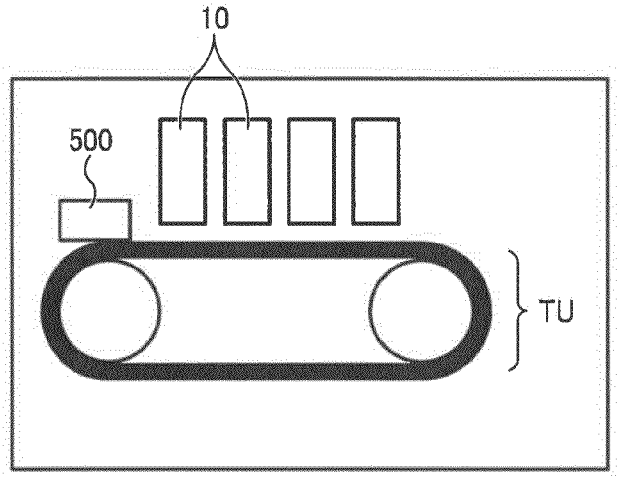
FIGS. 19B and 19C are side views of the image forming apparatus including the belt device shown in FIG. 19A for explaining a case where the unit TU is removed from the image forming apparatus.
Figure 19C:
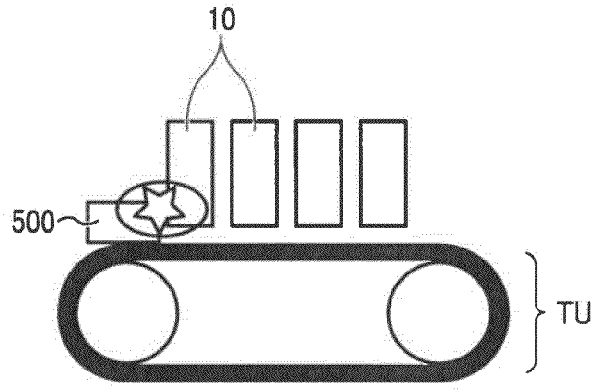

On the other hand, if the holder member 500A supporting the pressing member 500 is attached to the supporting member 200 of the tension roller 20 as shown in FIG. 19A, when the unit TU is to be removed from the image forming apparatus, the pressing member 500 interferes with the process units 10 as shown in FIG. 19C. As a result, the unit TU cannot be removed from the image forming apparatus. In this manner, the pressing member 500 is preferably attached to the fixed member separately from the unit TU including the intermediate transfer belt 15, the tension roller 20, and the supporting member 200.

Incidentally, in the configuration shown in FIGS. 19A to 19C, when the unit TU is to be installed in or removed from the image forming apparatus, following methods can be employed. After the process units 10 are removed from the image forming apparatus, the unit TU is removed from the image forming apparatus. As another method, the unit TU is moved to avoid interference with the process units 10, for example, in such a manner that the unit TU is pulled downward so that the pressing member 500 does not interfere with the process units 10, and then the unit TU is removed from the image forming apparatus. On the other hand, when the unit TU is to be installed in the image forming apparatus, in reverse order, the unit TU is set below the process units 10, and then lifted up to a home position. Furthermore, as still another method, a direction of installing/removing the unit TU is set to be a direction perpendicular to a sheet of the drawing.

Subsequently, modified examples of the supporting structure for the pressing member is explained below with reference to FIGS. 20 to 22.

Figure 20:
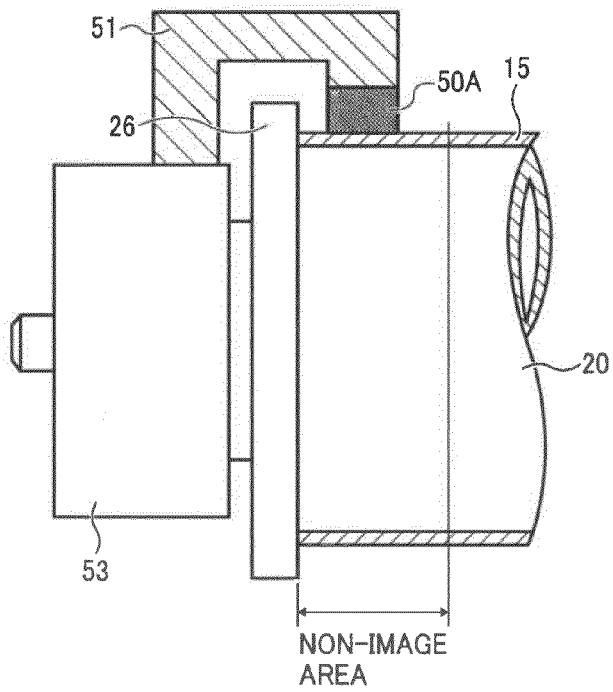
FIG. 20 is a partial front view of the belt device shown in FIG. 4 for explaining an example of a supporting structure of the pressing member.

In a case shown in FIG. 20, the holder 51 supporting the pressing member 50A is attached to a fixed member provided separately from the tension roller 20 and the intermediate transfer belt 15 that are movable members. Specifically, one end of the holder 51 is attached to a tension-roller bearing 53, which is located outside the flange 26 to be opposed to the edge surface of the intermediate transfer belt 15 across the flange 26. In a state where the holder 51 strides over the flange 26, the holder 51 extends between the tension-roller bearing 53 and the side of the intermediate transfer belt 15 so that the pressing member 50A can press on the surface of the intermediate transfer belt 15.

Figure 21:
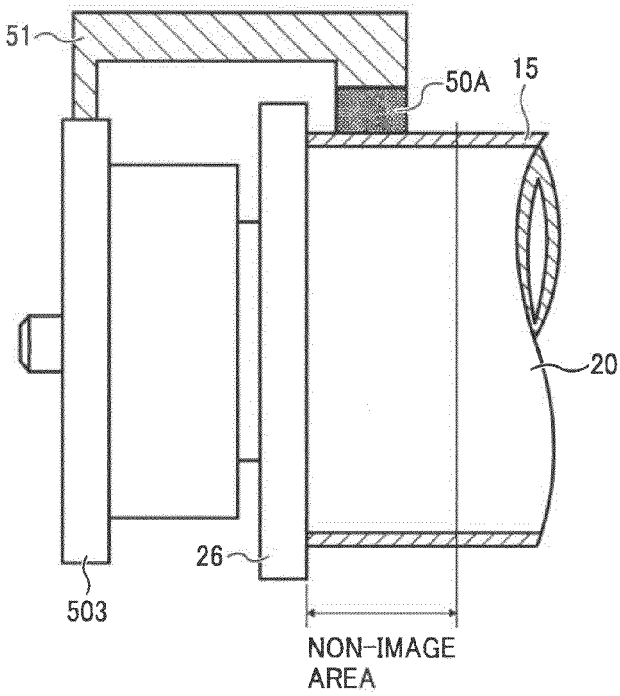
FIG. 21 is a partial front view of the belt device including a supporting structure as a first modified example of that is shown in FIG. 20.

In a case shown in FIG. 21, a rotating shaft of the tension roller 20 is supported by a side plate 503 corresponding to the fixed member. One end of the holder 51 supporting the pressing member 50A is attached to the side plate 503. In a state where the holder 51 strides over the flange 26, the holder 51 extends between the side plate 503 and the side of the intermediate transfer belt 15 so that the pressing member 50A can press on the surface of the intermediate transfer belt 15.

Figure 22:
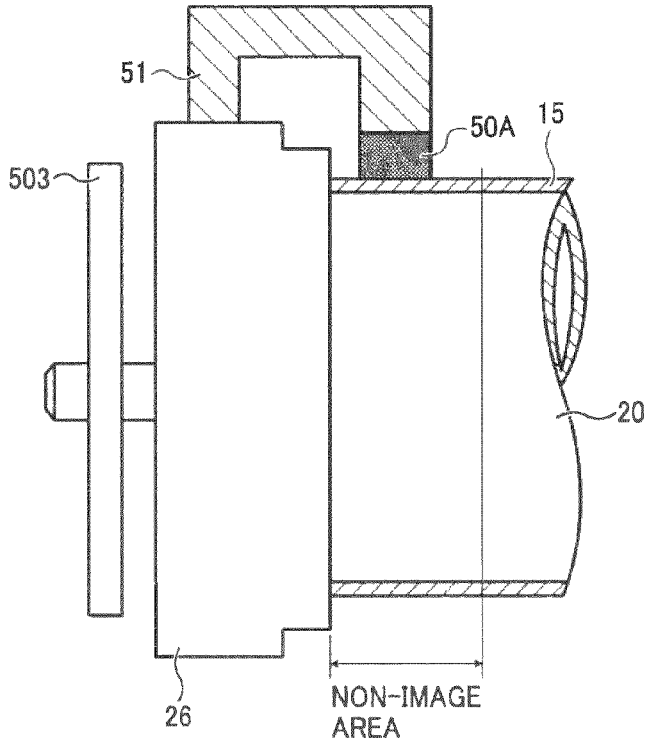
FIG. 22 is a partial front view of the belt device including a supporting structure as a second modified example of that is shown in FIG. 20.

In a case shown in FIG. 22, the flange 26 is configured not to move in conjunction with rotation of the tension roller 20, i.e., the flange 26 is fixed. One end of the holder 51 supporting the pressing member 50A is attached to the flange 26.

With any of the above supporting structures, the pressing member can be arranged to press on a portion of the intermediate transfer belt 15 where a buckling distortion of the intermediate transfer belt 15 tends to occur, i.e., near a portion of the edge surface of the intermediate transfer belt 15 in abutting contact with the flange 26. Therefore, the tension roller 20 and the intermediate transfer belt 15 can be configured as assemblies included in the unit TU.

Any of the above supporting structures can be employed depending on a configuration of the fixed member.

Figure 23:
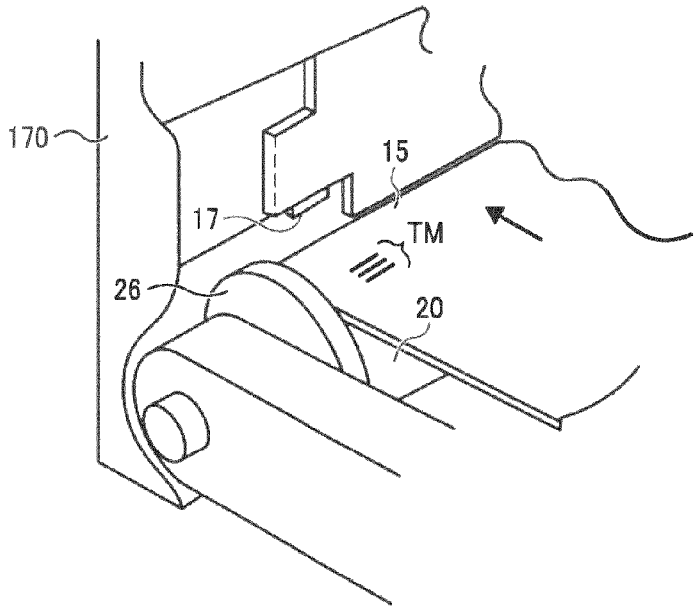
FIG. 23 is a partial perspective view of the image forming apparatus and the belt device including the pressing member shown in FIG. 4 for explaining an installation position of a toner-mark detecting sensor.

FIG. 23 is a partial perspective view of the image forming apparatus and the belt device for explaining an installation position of the toner-mark detecting sensor 17 shown in FIG. 1. In FIG. 23, the toner-mark detecting sensor 17 is installed on a toner-mark detecting sensor installation member 170 so that the toner-mark detecting sensor 17 can detect a toner mark formed on the intermediate transfer belt 15.

In this case, the pressing member is installed on the toner-mark detecting sensor installation member 170.

Figure 24:
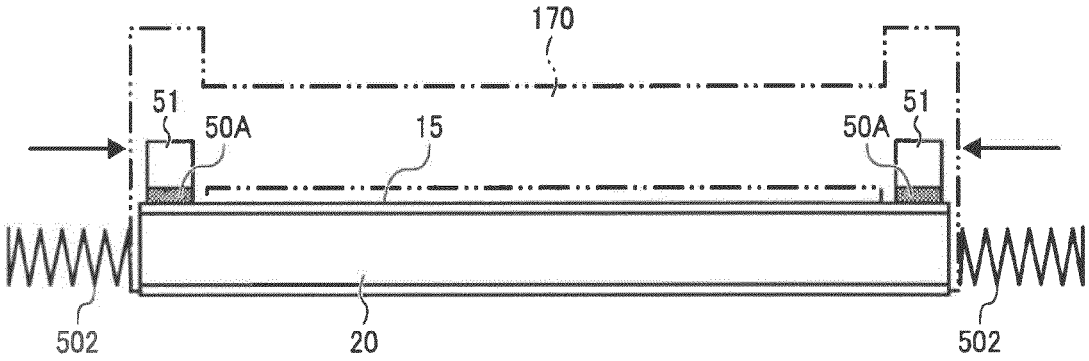
FIG. 24 is a front view of the belt device and a toner-mark detecting sensor installation member shown in FIG. 23.

FIG. 24 is a front view of the belt device shown in FIG. 23 for explaining an example of an installation position of the pressing member 50A supported by the holder 51. In the example shown in FIG. 24, the pressing members 50A are arranged on the toner-mark detecting sensor installation member 170 in such a manner that the pressing members 50A are respectively located near the edge surfaces of the intermediate transfer belt 15 in abutting contact with the flanges 26 (not shown in FIG. 24) provided on each of the end faces of the tension roller 20 in the axial direction.

Both end surfaces of the toner-mark detecting sensor installation member 170 along the axial direction of the tension roller 20 are respectively biased by the elastic member 502 so that each of the pressing members 50A pressing on the surface of the intermediate transfer belt 15 can be kept at the same position not to be displaced in the axial direction of the tension roller 20.

Figure 25:
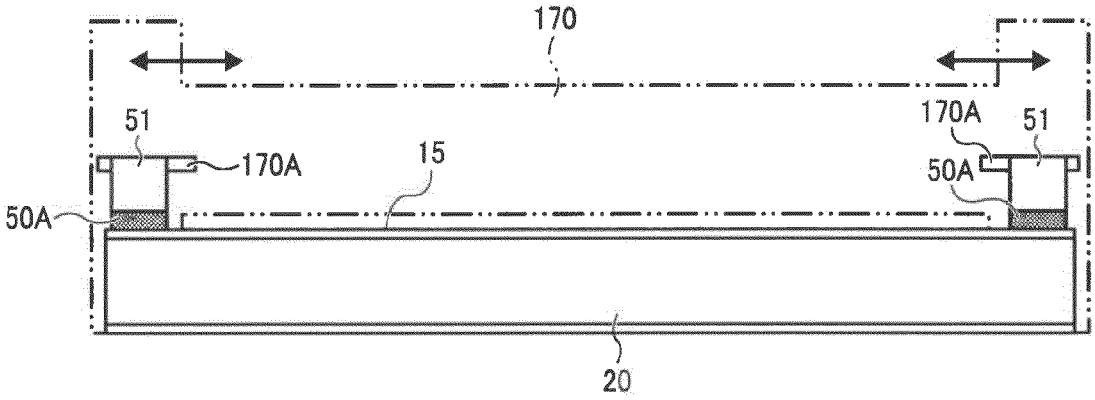
FIG. 25 is a front view of the belt device and a toner-mark detecting sensor installation member as a modified example of that is shown in FIG. 24.

FIG. 25 is a front view of the belt device and a toner-mark detecting sensor installation member as a modified example of that is shown in FIG. 24. In FIG. 25, two longitudinal grooves 170A are formed on the toner-mark detecting sensor installation member 170 so that an installation position of each of the pressing members 50A can be adjusted. The longitudinal grooves 170A are formed to be parallel to the axial direction of the tension roller 20.

Each of the holders 51 supporting the pressing members 50A is fitted in the corresponding longitudinal groove 170A. The holder 51 can move within the longitudinal groove 170A, so that the position of the pressing member 50A can be adjusted to the position where a buckling distortion of the intermediate transfer belt 15 tends to occur. Therefore, even when the apparatus is manufactured with a slight degree of dimensional accuracy error, the position of each of the pressing members 50A with respect to the intermediate transfer belt 15 can be adjusted within the range of the longitudinal groove 170A. Thus, it is possible to prevent an occurrence of a buckling distortion of the intermediate transfer belt 15.

Such a configuration can be applied to a case where the toner-mark detecting sensor installation member 170 is unitized as a unit on which the pressing member is to be installed.

The pressing member needs to be configured not only to slide on the surface of the intermediate transfer belt 15 but also not to inhibit the movement of the intermediate transfer belt 15 as those shown in FIGS. 4 and 6.

The belt device according to the present embodiment is applied to the intermediate transfer belt as described above. Alternatively, the belt device can be applied to a belt used as a latent-image carrier, or a belt used for conveying a recording medium.

Subsequently, a belt device according to a second embodiment of the present invention is explained below. The portions identical to those for the first embodiment are denoted with the same reference numerals, and the description of those portions is omitted.

Figure 26:
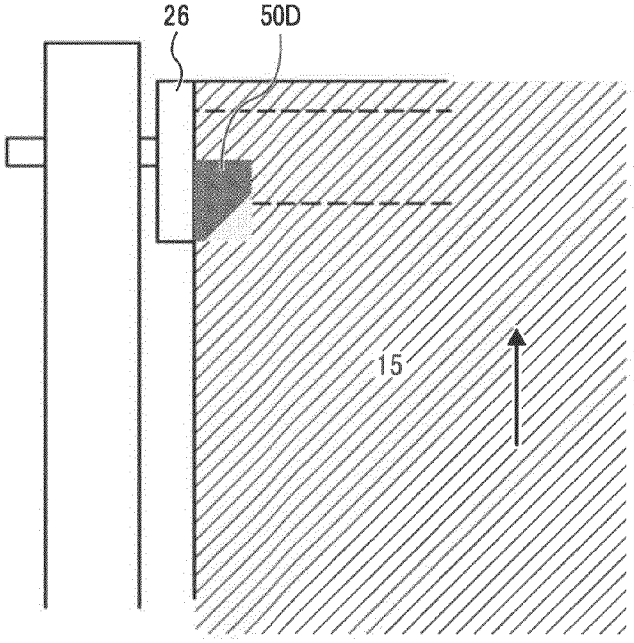
FIG. 26 is a partial plan view of a belt device according to a second embodiment of the present invention.

FIG. 26 is a partial plan view of the belt device according to the second embodiment. As shown in FIG. 26, the belt device includes a pressing member 50D that tapers toward the medial side of the intermediate transfer belt 15, so that a toner deposited on the pressing member 50D can be gradually run into the medial side of the intermediate transfer belt 15. In other words, a toner exceeding a certain amount is run into the medial side of the intermediate transfer belt 15. Therefore, a toner is hard to be deposited on the pressing member 50D, whereby it is possible to prevent a scattering of the toner.

The pressing member 50D can be made of resin having a high sliding property, such as sliding POM or sliding ABS, a sliding sponge, felt, an elastic member such as a rubber blade, or the like.

A horizontal width of a pressing surface of the pressing member 50D to be pressed against the intermediate transfer belt 15 in the width direction is 2 mm to 5 mm because it is necessary to save space for an image area on the intermediate transfer belt 15 for 210 mm for a horizontal width of an A4-size sheet or 216 mm for a horizontal width of a letter-size sheet. Therefore, it is possible to prevent a buckling distortion of the intermediate transfer belt 15 without interference with the image area, and it is also possible to achieve a stable belt drive for a long time.

Figure 27:
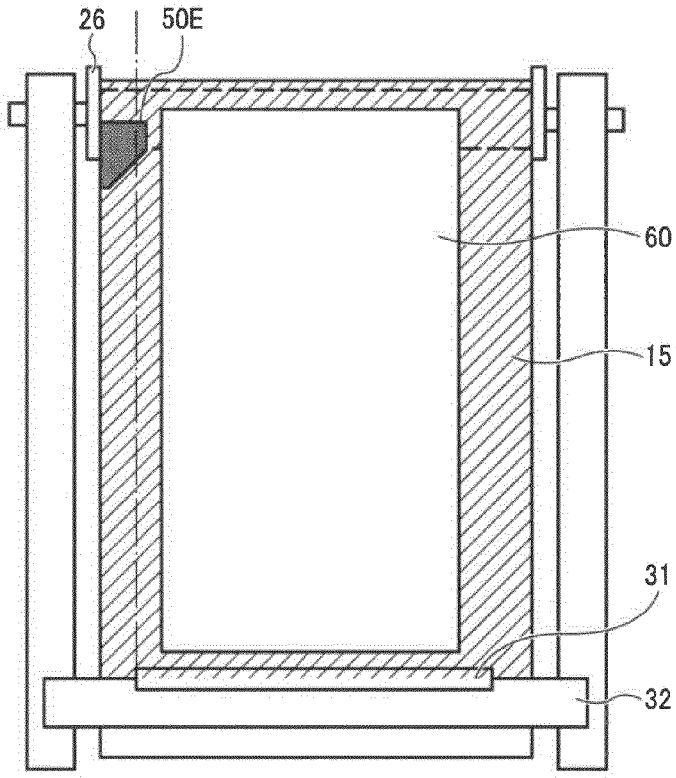
FIG. 27 is a plan view of the belt device including a pressing member as a first modified example of that is shown in FIG. 26 for explaining relative positions of the pressing member and a cleaning blade of an intermediate-transfer-belt cleaning unit.

FIG. 27 is a plan view of the belt device including a pressing member 50E as a first modified example of the pressing member 50D shown in FIG. 26 for explaining relative positions of the pressing member 50E and the cleaning blade 31 of the intermediate-transfer-belt cleaning unit 32. As shown in FIG. 27, the pressing member 50E is arranged in such a manner that a tapered end portion of the pressing member 50E is located outside of an image area 60 for a letter-size sheet and also located on the inner side of an end of the cleaning blade 31. Therefore, a toner deposited on the pressing member 50E can be run into the medial side of the intermediate transfer belt 15, and re-collected by the cleaning blade 31.

Specifically, the tapered end portion of the pressing member 50E is located outside of the image area 60, so that it is possible to lessen such a possibility that a toner comes in contact with the flange 26 or is deposited on the flange 26. However, the cleaning blade 31 is set to clean the whole image area and outside of the image area, so that there is a high possibility that a toner comes in contact with the flange 26. To avoid this problem, the pressing member 50E is arranged on the inner side of the end of the cleaning blade 31, and has a tapered shape. Therefore, a toner deposited on the pressing member 50E can be gathered on the medial side of the intermediate transfer belt 15, and re-collected by the cleaning blade 31. Thus, it is possible to prevent a scattering of the toner. Furthermore, it is not necessary to provide any additional member other than the pressing member 50E to prevent a scattering of the toner. Thus, it is possible to reduce the production cost.

Moreover, even when a toner leaks from an end portion of the intermediate-transfer-belt cleaning unit 32, a toner exceeding a certain amount is gradually run into the medial side of the intermediate transfer belt 15 because of the tapered shape of the pressing member 50E. Therefore, a toner is hard to be deposited on the pressing member 50E, whereby it is possible to prevent a scattering of the toner. Consequently, it is possible to prevent an energization error caused by a scattering of the toner deposited on the pressing member 50E in such a manner that inside the unit including the intermediate transfer belt 15 is prevented from being stained with the scattered toner, and it is also possible to prevent a light receiving unit of the toner-mark sensor from being stained with the scattered toner. Thus, the intermediate transfer belt 15 can move stably for a long time.

Figure 28:
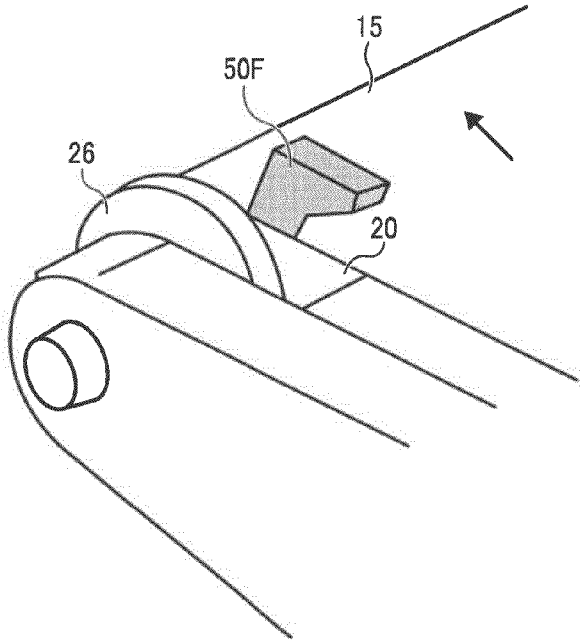
FIG. 28 is a partial perspective view of the belt device including a pressing member as a second modified example of that is shown in FIG. 26.

FIG. 28 is a partial perspective view of the belt device including a pressing member 50F as a second modified example of the pressing member 50D shown in FIG. 26. The pressing member 50F includes a toner storing unit (not shown) in which a toner deposited on the pressing member 50F is temporarily stored. The toner storing unit is arranged in a portion of the pressing member 50F where the pressing member 50F is in contact with the intermediate transfer belt 15 on the upstream side in the moving direction of the intermediate transfer belt 15. Therefore, it is possible to prevent a scattering of the toner deposited on the pressing member 50F. Furthermore, the toner can be efficiently run into the medial side of the intermediate transfer belt 15.

Moreover, a space is formed between the pressing member 50F and the intermediate transfer belt 15, so that even when a toner is scattered, the toner is scattered through the space. Therefore, it is possible to prevent the toner from being scattered to outside the space.

Figure 29:
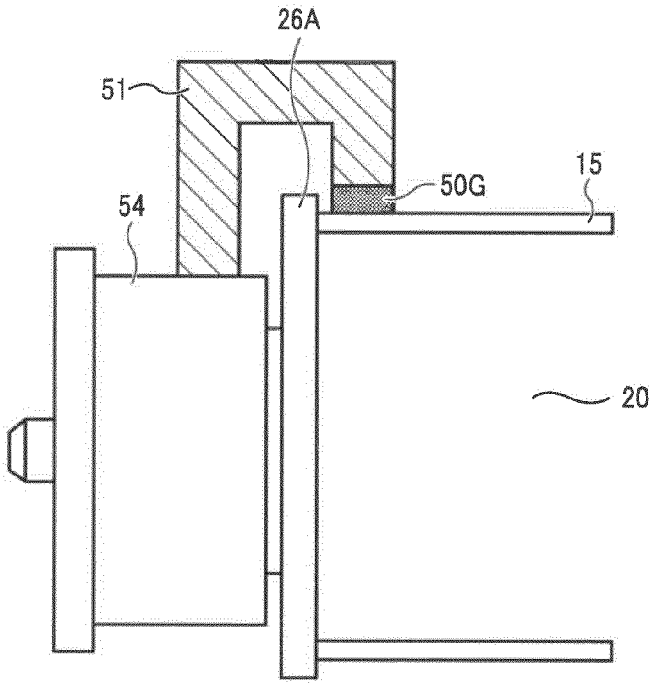
FIG. 29 is a partial front view of a belt device as a first modified example of that is shown in FIG. 26.

FIG. 29 is a partial front view of a belt device as a first modified example of that is shown in FIG. 26. In FIG. 29, a pressing member 50G is supported by the holder 51 attached to a bearing 54. The bearing 54 is located outside a flange 26A. The pressing members 50G are respectively provided on both sides of the intermediate transfer belt 15 in the width direction. The holder 51 extends to stride over the flange 26A so that the holder 51 can support the pressing member 50G at a fixed position with respect to the intermediate transfer belt 15. Therefore, the pressing member 50G can serve to prevent a buckling distortion of a portion of the intermediate transfer belt 15 in abutting contact with the flange 26A. Thus, the durability of the belt device can be improved with such a simple configuration at low cost.

Figure 30:
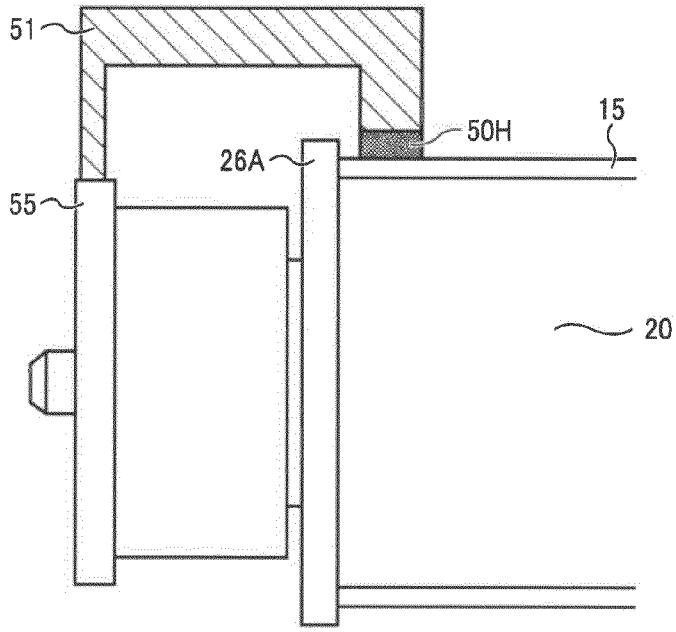
FIG. 30 is a partial front view of a belt device as a second modified example of that is shown in FIG. 26.

FIG. 30 is a partial front view of a belt device as a second modified example of that is shown in FIG. 26. In FIG. 30, a pressing member 50H is supported by the holder 51 attached to a plate 55. The plate 55 supports a shaft of the tension roller 20, which is located outside the flange 26A. The pressing member 50H can be provided on both sides or either one side of the intermediate transfer belt 15 in the width direction. The plate 55 is configured not to move in conjunction with rotation of the tension roller 20. The pressing member 50H can serve to prevent a buckling distortion of a portion of the intermediate transfer belt 15 in abutting contact with the flange 26A.

Figure 31:
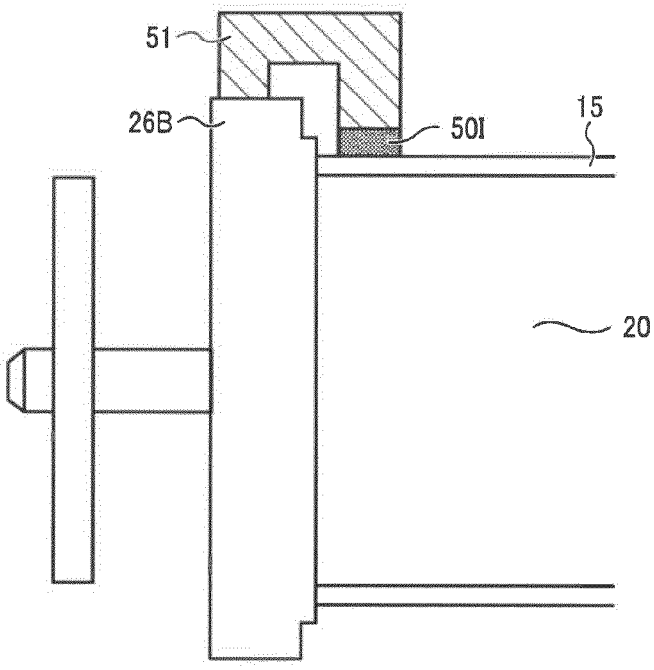
FIG. 31 is a partial front view of a belt device as a third modified example of that is shown in FIG. 26.

FIG. 31 is a partial front view of a belt device as a third modified example of that is shown in FIG. 26. In FIG. 31, a pressing member 50I is supported by the holder 51 attached to a flange 26B. The flange 26B is configured not to move in conjunction with rotation of the tension roller 20. The pressing member 50I is provided on both sides or either one side of the intermediate transfer belt 15 in the width direction. The holder 51 is fixedly attached to the flange 26B by a snap hook, a screw, an adhesive agent, or the like. The pressing member 50I is arranged so that the pressing member 50I can press on a portion of the intermediate transfer belt 15 in abutting contact with the flange 26B. Therefore, it is possible to prevent a buckling distortion of the portion of the intermediate transfer belt 15 in abutting contact with the flange 26B.

In this manner, with the pressing member, it is possible to prevent an occurrence of an energization error or a process control error that is caused by a scattering of a toner deposited on the pressing member. In other words, it is possible to prevent an occurrence of an energization error or a process control error by preventing inside the transfer unit or the light receiving unit of the toner-mark sensor from being stained with the scattered toner. Therefore, with only the pressing member, it is possible to prevent a buckling distortion of the intermediate transfer belt 15, and also it is possible to achieve a stable belt drive for a long time.

As described above, according to an aspect of the present invention, in a case of a belt device in which a flange is provided to prevent a meandering of a belt, a pressing member presses on a portion of an edge surface of the belt in abutting contact with the flange, and thereby preventing a buckling distortion of the belt. Therefore, it is possible to reliably prevent a decrease of the durability of the belt and an occurrence of a color registration error that are caused by the buckling distortion. Especially, the pressing member is configured to press on a surface of the belt at a position near a portion of the edge surface of the belt in abutting contact with the flange. Therefore, unlike such a configuration that the pressing member presses down on the belt to prevent an uplift behavior of the belt, i.e., a gap formed between the belt and a roller, the pressing member presses on the belt to prevent an occurrence of undulation of the belt, i.e., an occurrence of a distortion of the belt before happens. Thus, it is possible to reliably prevent an occurrence of a buckling distortion of the belt.

Furthermore, with such a simple configuration that only the pressing member is provided to prevent a buckling distortion of the belt, it is possible to improve the durability of the belt without increasing a cost due to the use of a high stiffness belt in consideration of the durability, and also it is possible to avoid forming a defect image due to a color registration error or the like.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A belt device comprising:

a belt that is supported by a plurality of rollers and is driven to move in a predetermined direction;

a flange member configured to make contact with a portion of an edge surface of the belt in its width direction;

a cleaning unit that cleans toner attached on the belt; and a pressing member that presses on a surface of the belt in its thickness direction at a position near a contact portion of the belt with the flange member, wherein:

the pressing member has a tapered shape such that the pressing member tapers toward a medial side of the belt, and the cleaning unit collects a toner moved from the pressing member to the medial side of the belt.

2. The belt device according to claim 1, further comprising a toner storing unit that temporarily stores therein the toner, being arranged on an upstream side of a position where the pressing member presses on the belt in a moving direction of the belt.

3. The belt device according to claim 1, wherein a first end of the pressing member is attached to the flange member or a fixed member of the belt device located outside the flange member, and a second end of the pressing member presses on the belt.

4. The belt device according to claim 3, wherein when the flange member moves in conjunction with a rotation of a roller that supports the belt, the first end of the pressing member is attached to the fixed member, and the second end of the pressing member presses on the belt and strides over the flange member.

5. The belt device according to claim 1, wherein the pressing member is a slidable member.

6. An image forming apparatus, comprising:

a device which forms images; and the belt device according to claim 1.

7. The belt device according to claim 1, wherein:

the tapered shape of the pressing member faces towards an upstream direction, relative to a travel direction of the belt, and a portion of the tapered shape at an outer portion of the pressing member is more upstream, relative to the direction of travel of the belt, than a portion of the tapered shape at an inner portion of the pressing member which is closer to the medial side of the belt than the outer portion of the pressing member.

8. A belt device comprising:

a belt that is supported by a plurality of rollers and is driven to move in a predetermined direction;

a flange member configured to make contact with a portion of an edge surface of the belt in its width direction;

a cleaning unit that cleans toner attached on the belt; and a pressing member that presses on a surface of the belt in its thickness direction at a position near a contact portion of the belt with the flange member, wherein:

the pressing member has a tapered shape such that the pressing member tapers toward a medial side of the belt, the pressing member is arranged outside of an image area for forming an image on the belt, and an end of the pressing member towards the medial side of the belt is located on a line extending from an end of the cleaning unit or inside the line in a direction of the medial side of the belt.

9. The belt device according to claim 8, wherein:

the tapered shape of the pressing member faces towards an upstream direction, relative to a travel direction of the belt, and a portion of the tapered shape at an outer portion of the pressing member is more upstream, relative to the direction of travel of the belt, than a portion of the tapered shape at an inner portion of the pressing member which is closer to the medial side of the belt than the outer portion of the pressing member.

10. A belt device comprising:

a belt that is supported by a plurality of rollers and is driven to move in a predetermined direction;

a flange member configured to make contact with a portion of an edge surface of the belt in its width direction;

a cleaning unit that cleans toner attached on the belt; and a pressing member that presses on a surface of the belt in its thickness direction at a position near a contact portion of the belt with the flange member, wherein:

the pressing member has a tapered shape such that the pressing member tapers toward a medial side of the belt, a first end of the pressing member is attached to the flange member or a fixed member of the belt device located outside the flange member, and a second end of the pressing member presses on the belt, and when the flange member does not move in conjunction with a rotation of a roller that supports the belt, the first end of the pressing member is attached to the flange member, and the second end of the pressing member presses on the belt.

11. The belt device according to claim 10, wherein:

the tapered shape of the pressing member faces towards an upstream direction, relative to a travel direction of the belt, and a portion of the tapered shape at an outer portion of the pressing member is more upstream, relative to the direction of travel of the belt, than a portion of the tapered shape at an inner portion of the pressing member which is closer to the medial side of the belt than the outer portion of the pressing member.

12. A belt device comprising:

a belt that is supported by a plurality of rollers and is driven to move in a predetermined direction;

a flange member configured to make contact with a portion of an edge surface of the belt in its width direction;

a cleaning unit that cleans toner attached on the belt; and a pressing member that presses on a surface of the belt in its thickness direction at a position near a contact portion of the belt with the flange member, wherein:

the pressing member has a tapered shape such that the pressing member tapers toward a medial side of the belt, and the pressing member is a felt member.

13. The belt device according to claim 12, wherein:

the tapered shape of the pressing member faces towards an upstream direction, relative to a travel direction of the belt, and a portion of the tapered shape at an outer portion of the pressing member is more upstream, relative to the direction of travel of the belt, than a portion of the tapered shape at an inner portion of the pressing member which is closer to the medial side of the belt than the outer portion of the pressing member.

14. A belt device comprising:

a belt that is supported by a plurality of rollers including at least a drive roller that drives the belt to move in a predetermined direction and a tension roller that applies a tension to the belt;

a flange member that is configured to make contact with a portion of an edge surface of the belt in its width direction and that is provided on an end face of the tension roller;

a pressing member that presses on a surface of the belt in its thickness direction at a position near a contact portion of the belt with the flange member, a non-rotatable portion of the pressing member pressing on the surface of the belt; and an elastic member, wherein the pressing member is in contact with a curved portion of the belt where the belt is supported by the tension roller; and wherein the pressing member presses on the surface of the belt in its thickness direction by use of elastic force of the elastic member.

15. The belt device according to claim 14, wherein the pressing member wraps around the curved portion of the belt.

16. The belt device according to claim, further comprising:

a fixed member that supports the elastic member.

17. The belt device according to claim 16, wherein:

one end of the elastic member is supported by the pressing member and the other end of the elastic member is supported by the fixed member, and the one end is provided at a position closer to the surface of the belt than a position of the other end.

18. The belt device according to claim 16, wherein:

the fixed member is a bearing of the tension-roller.

19. The belt device according to claim 16, wherein:

the fixed member is a side plate attached to one end of a shaft of the tension roller.

20. The belt device according to claim 14, further comprising:

a cleaning blade that comes into contact with the belt to clean the belt, wherein a contact position between the cleaning blade and the belt and a contact position between the pressing member and the belt are spaced apart in the predetermined direction of movement of the belt.

21. The belt device according to claim 14, wherein:

the pressing member is outside of an image forming area on the belt in the width direction of the belt.

22. The belt device according to claim 16, wherein:

the fixed member includes an extension portion that extends from outside to inside of the flange member in the width direction of the belt.

23. The belt device according to claim 22, wherein:

the extension portion is integrally molded with the fixed member.

24. The belt device according to claim 14, wherein:

the pressing member comprises felt.

25. The belt device according to claim 14, wherein:

the flange member has a diameter larger than an external diameter of the tension roller.

26. The belt device according to claim 14, wherein:

a length of the belt in contact with the pressing member is a length of the belt wound around an outer circumferential surface of the tension roller.

a fixed member that supports the elastic member.

27. A belt device comprising:

a belt that is supported by a plurality of rollers including at least a drive roller that drives the belt to move in a predetermined direction and a tension roller that applies a tension to the belt;

a flange member that is configured to make contact with a portion of an edge surface of the belt in its width direction and that is provided on an end face of the tension roller;

a pressing member that presses on a surface of the belt in its thickness direction at a position outside of an image forming area on the belt in the width direction of the belt;

a supporting member that supports the pressing member; and a spring, wherein a non-rotatable portion of the pressing member is in contact with a curved portion of the belt, and wherein the pressing member presses on the surface of the belt in its thickness direction by a force of the spring.

28. A belt device comprising:

a belt supported by a plurality of rollers including at least a drive roller that drives the belt to move in a predetermined direction and a tension roller that applies a tension to the belt;

a flange member configured to contact a portion of an edge surface of the belt in a width direction of the belt and provided on an end face of the tension roller;

a spring;

a pressing member that presses on an outside surface of the belt by a force of the spring at a position outside of an image forming area on the belt in the width direction of the belt; and a supporting member including an extension portion that extends from outside to inside of the flange member in the width direction of the belt, wherein the extension portion is integrally molded with the supporting member, and wherein one end of the spring is supported by the pressing member and the other end of the spring is supported by the extension portion of the supporting member.

29. The belt device according to claim 28, wherein the supporting member is a bearing of the tension roller.

30. The belt device according to claim 28, wherein the pressing member wraps around the curved portion of the belt.

31. The belt device according to claim 28, wherein a pressing surface of the pressing member which contacts the outside surface of the belt comprises felt.

32. The belt device according to claim 28, wherein a pressing surface of the pressing member which contacts the outside surface of the belt comprises sponge.

* * * * *